US008253678B2

(12) United States Patent
Shiomi

(10) Patent No.: US 8,253,678 B2
(45) Date of Patent: Aug. 28, 2012

(54) DRIVE UNIT AND DISPLAY DEVICE FOR SETTING A SUBFRAME PERIOD

(75) Inventor: Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 763 days.

(21) Appl. No.: 11/884,230

(22) PCT Filed: Mar. 14, 2006

(86) PCT No.: PCT/JP2006/305039

§ 371 (c)(1),
(2), (4) Date: Aug. 13, 2007

(87) PCT Pub. No.: WO2006/098328

PCT Pub. Date: Sep. 21, 2006

(65) Prior Publication Data

US 2010/0156963 A1 Jun. 24, 2010

(30) Foreign Application Priority Data

Mar. 15, 2005 (JP) ..... 2005-073884
Mar. 15, 2005 (JP) ..... 2005-074009

(51) Int. Cl.
*G09G 3/36* (2006.01)
*G09G 5/02* (2006.01)

(52) U.S. Cl. ..... 345/99; 345/699

(58) Field of Classification Search ..... 345/94, 345/699, 99

See application file for complete search history.

(56) References Cited

U.S. PATENT DOCUMENTS 5,390,293 A 2/1995 Nishioka et al.
5,488,389 A * 1/1996 Nakanishi et al. ..... 345/670
5,818,419 A 10/1998 Tajima et al.
5,874,933 A 2/1999 Hirai et al.
6,222,515 B1 * 4/2001 Yamaguchi et al. ..... 345/691
6,310,588 B1 10/2001 Kawahara et al.
6,359,663 B1 3/2002 Gadeyne et al.
6,466,225 B1 10/2002 Larkin et al.

(Continued)

FOREIGN PATENT DOCUMENTS

JP 56117483 A * 9/1981

(Continued)

OTHER PUBLICATIONS

Translation of JP 56-117483; Shimosaka, "Discrimination Circuits for Receiving System", PUB. Sep. 1981, p. 1-17.*

(Continued)

*Primary Examiner* — Adam J Snyder
(74) *Attorney, Agent, or Firm* — Harness, Dickey & Pierce, P.L.C.

(57) ABSTRACT

In one embodiment of the present invention, a drive unit of a display device is a drive unit that drives a display device in which one frame is divided into a plurality of sub-frames so that display of input video data is realized by summation of displays of the sub-frames, and the drive unit includes: a sub-frame data generating section generating sets of sub-frame data corresponding to the respective sub-frames; and a sub-frame period fixing section setting at least one sub-frame period to a given value regardless of a type of the input video data. This makes it possible to prevent variations of display quality with respective to various kinds of input video signals.

16 Claims, 19 Drawing Sheets

| | PAL | NTSC |
|---|---|---|
| | 50[Hz] | 60[Hz] |
| DOT CLOCK Dcf [MHz] | 130 | 130 |
| Vtotal (Vα) OF FIRST SUB-FRAME [LINE] | 820 | 820 |
| Vtotal (Vβ) OF SECOND SUB-FRAME [LINE] | 830 | 830 |
| Htotal (Hα) OF FIRST SUB-FRAME [DOT] | 1236 | 1236 |
| Htotal OF SECOND SUB-FRAME [DOT] | 1910 | 1388 |
| FIRST SUB-FRAME (DARK DISPLAY) PERIOD [ms] | 7.80 | 7.80 |
| SECOND SUB-FRAME (BRIGHT DISPLAY) PERIOD [ms] | 12.2 | 8.87 |
| FRAME PERIOD [ms] | 20.0 | 16.7 |

U.S. PATENT DOCUMENTS

| | | | | |
|---|---|---|---|---|
| 6,542,141 | B1 | 4/2003 | Mano et al. | |
| 6,646,625 | B1 | 11/2003 | Shigeta et al. | |
| 6,771,243 | B2 * | 8/2004 | Hirohata | 345/89 |
| 6,803,894 | B1 * | 10/2004 | Hirota et al. | 345/88 |
| 6,894,669 | B2 * | 5/2005 | Suzuki et al. | 345/87 |
| 6,937,224 | B1 | 8/2005 | Miyachi | |
| 7,002,540 | B2 * | 2/2006 | Aoki | 345/94 |
| 7,123,226 | B2 * | 10/2006 | Ham | 345/89 |
| 7,133,015 | B1 | 11/2006 | Yoshida et al. | |
| 7,205,987 | B2 | 4/2007 | Sagano et al. | |
| 2001/0026256 | A1 | 10/2001 | Sugiyama | |
| 2001/0028347 | A1 | 10/2001 | Kawahara et al. | |
| 2001/0052886 | A1 | 12/2001 | Ikeda | |
| 2002/0003520 | A1 | 1/2002 | Aoki | |
| 2002/0003522 | A1 | 1/2002 | Baba et al. | |
| 2002/0024481 | A1 | 2/2002 | Kawabe et al. | |
| 2002/0044105 | A1 | 4/2002 | Nagai | |
| 2002/0044151 | A1 | 4/2002 | Ijima et al. | |
| 2002/0051153 | A1 | 5/2002 | Hiyama et al. | |
| 2002/0105506 | A1 | 8/2002 | Hiyama et al. | |
| 2002/0109659 | A1 | 8/2002 | Hiroki | |
| 2003/0011614 | A1 | 1/2003 | Itoh et al. | |
| 2003/0146893 | A1 | 8/2003 | Sawabe | |
| 2003/0218587 | A1 | 11/2003 | Ikeda | |
| 2003/0227429 | A1 | 12/2003 | Shimoshikiryo | |
| 2004/0001167 | A1 | 1/2004 | Takeuchi et al. | |
| 2004/0066355 | A1 | 4/2004 | Shigeta et al. | |
| 2004/0125064 | A1 | 7/2004 | Adachi et al. | |
| 2004/0155847 | A1 | 8/2004 | Taoka et al. | |
| 2004/0239698 | A1 | 12/2004 | Kamada et al. | |
| 2004/0263462 | A1 | 12/2004 | Igarashi | |
| 2005/0078060 | A1 | 4/2005 | Shigeta et al. | |
| 2005/0088370 | A1 | 4/2005 | Shigeta et al. | |
| 2005/0156843 | A1 | 7/2005 | Itoh et al. | |
| 2005/0162359 | A1 | 7/2005 | Sugino | |
| 2005/0162360 | A1 | 7/2005 | Ishihara et al. | |
| 2005/0184944 | A1 | 8/2005 | Miyata et al. | |
| 2005/0213015 | A1 | 9/2005 | Shimoshikiryo | |
| 2005/0253785 | A1 | 11/2005 | Miyasaka et al. | |
| 2005/0253793 | A1 * | 11/2005 | Chien et al. | 345/87 |
| 2005/0253798 | A1 | 11/2005 | Hiyama et al. | |
| 2006/0125765 | A1 | 6/2006 | Hiyama et al. | |
| 2006/0125812 | A1 | 6/2006 | Lee | |
| 2006/0139289 | A1 | 6/2006 | Yoshida et al. | |
| 2006/0187361 | A1 * | 8/2006 | Fujine et al. | 348/790 |
| 2006/0214897 | A1 | 9/2006 | Murai | |
| 2008/0129762 | A1 | 6/2008 | Shiomi | |
| 2008/0136752 | A1 | 6/2008 | Inoue et al. | |
| 2008/0158443 | A1 | 7/2008 | Shiomi | |
| 2009/0122207 | A1 | 5/2009 | Inoue et al. | |
| 2009/0167791 | A1 | 7/2009 | Shiomi | |

FOREIGN PATENT DOCUMENTS

| | | |
|---|---|---|
| JP | 03-174186 | 7/1991 |
| JP | 04-302289 | 10/1992 |
| JP | 05-068221 | 3/1993 |
| JP | 06-083295 | 3/1994 |
| JP | 6-118928 | 4/1994 |
| JP | 07-294881 | 11/1995 |
| JP | 08-076090 | 3/1996 |
| JP | 8-114784 | 5/1996 |
| JP | 2650479 | 9/1997 |
| JP | 10-161600 | 6/1998 |
| JP | 10-274961 | 10/1998 |
| JP | 11-231827 | 8/1999 |
| JP | 11-352923 | 12/1999 |
| JP | 2000-29442 | 1/2000 |
| JP | 2000-187469 | 7/2000 |
| JP | 2001-56665 | 2/2001 |
| JP | 2001-60078 | 3/2001 |
| JP | 2001-184034 | 7/2001 |
| JP | 2001-281625 | 10/2001 |
| JP | 2001-296841 | 10/2001 |
| JP | 2001-350453 | 12/2001 |
| JP | 2002-23707 | 1/2002 |
| JP | 2002-091400 | 3/2002 |
| JP | 2002-108294 | 4/2002 |
| JP | 2002-131721 | 5/2002 |
| JP | 2002-229547 | 8/2002 |
| JP | 2002-236472 | 8/2002 |
| JP | 2003-22061 | 1/2003 |
| JP | 2003-058120 | 2/2003 |
| JP | 2003-114648 | 4/2003 |
| JP | 2003-177719 | 6/2003 |
| JP | 2003-222790 | 8/2003 |
| JP | 2003-262846 | 9/2003 |
| JP | 2003-295160 | 10/2003 |
| JP | 2004-062146 | 2/2004 |
| JP | 2004-078157 | 3/2004 |
| JP | 2004-240317 | 8/2004 |
| JP | 2004-246312 | 9/2004 |
| JP | 2004-258139 | 9/2004 |
| JP | 2004-302270 | 10/2004 |
| JP | 2004-309622 | 11/2004 |
| JP | 2005-173387 | 6/2005 |
| JP | 2005-234552 | 9/2005 |
| JP | 2006-171749 | 6/2006 |
| JP | 2006-301563 | 11/2006 |
| WO | WO 03098588 | 11/2003 |
| WO | WO 2004086349 A1 * | 10/2004 |
| WO | WO 2006/030842 | 3/2006 |
| WO | WO 2006/098194 | 9/2006 |
| WO | WO 2006/098246 | 9/2006 |
| WO | WO 2006/100906 | 9/2006 |
| WO | WO 2006/100988 | 9/2006 |
| WO | WO 2006098246 | 9/2006 |
| WO | WO 2007/060783 | 5/2007 |

OTHER PUBLICATIONS

"Handbook of Color Science," second edition. University of Tokyo Press, published on Jun. 10, 1998, pp. 92-93, pp. 362-367, and partial English translation thereof.

Sang Soo Kim. "Invited Paper: Super PVA Sets New State-of-the-Art for LCD-TV," SID 04 Digest, 2004, pp. 760-763.

Jang-Kun Song. "48.2: DCCII: Novel Method for Fast Response Time in PVA Mode," SID 04 Digest, 2004, pp. 1344-1347.

International Search Report for Corresponding PCT Application PCT/JP2006/317619.

International Search Report for Corresponding PCT Application PCT/JP2006/304792.

International Search Report for Corresponding PCT Application PCT/JP2006/304396.

U.S. Office Action dated Jan. 21, 2011.

U.S. Office Action dated Mar. 11, 2011.

U.S. Office Action dated Mar. 15, 2011.

U.S. Notice of Allowance dated May 27, 2011 for U.S. Appl. No. 11/794,153.

U.S. Office Action dated Aug. 17, 2011 for U.S. Appl. No. 12/085,461.

Office Action mailed Mar. 13, 2012 for corresponding U.S. Appl. No. 12/085,461.

International Search Report PCT/ISA/210, Mar. 14, 2006.

PCT Form PCT/IB/304, May 22, 2006.

Written Opinion PCT/ISA/237, May 25, 2006.

U.S. Office Action mailed Sep. 1, 2010 for corresponding U.S. Appl. No. 11/794,153.

U.S. Office Action mailed Sep. 27, 2010 for corresponding U.S. Appl. No. 11/883,941.

U.S. Office Action mailed Sep. 14, 2010 for corresponding U.S. Appl. No. 11/886,226.

U.S. Office Action mailed Sep. 23, 2010 for corresponding U.S. Appl. No. 11/794,948.

International Search Report for Corresponding PCT Application PCT/JP2006/317619, Nov. 29, 2006.

Written Opinion for PCT/JP2006/317619, Nov. 29, 2006.

International Search Report for PCT/JP2006/304433, Apr. 14, 2006.

International Search Report for Corresponding PCT Application PCT/JP2006/305172, Apr. 14, 2006.

Written Opinion for Corresponding PCT Application PCT/JP2006/305172, Apr. 11, 2006.
Office Action mailed Jan. 17, 2012 for corresponding U.S. Appl. No. 11/883,941.
Office Action mailed Jan. 17, 2012 for corresponding U.S. Appl. No. 11/794,948.

* cited by examiner

FIG. 5

| | LUT18 | LUT19 |
|---|---|---|
| INPUT GRAYSCALE | OUTPUT GRAYSCALE | OUTPUT GRAYSCALE |
| 0 | Gmin | Gmin |
| ⋮ | ⋮ | ⋮ |
| Gx | Gp | Gq |
| ⋮ | ⋮ | ⋮ |
| L1 | | |
| L2 | Gmin | Gmax |
| L3 | | |
| ⋮ | ⋮ | ⋮ |
| 255 | Gmax | Gmax |

FIG. 6

| | PAL | NTSC |
|---|---|---|
| | 50[Hz] | 60[Hz] |
| DOT CLOCK Dcf [MHz] | 130 | 130 |
| Vtotal (Vα) OF FIRST SUB-FRAME [LINE] | 820 | 820 |
| Vtotal (Vβ) OF SECOND SUB-FRAME [LINE] | 830 | 830 |
| Htotal (Hα) OF FIRST SUB-FRAME [DOT] | 1236 | 1236 |
| Htotal OF SECOND SUB-FRAME [DOT] | 1910 | 1388 |
| FIRST SUB-FRAME (DARK DISPLAY) PERIOD [ms] | 7.80 | 7.80 |
| SECOND SUB-FRAME (BRIGHT DISPLAY) PERIOD [ms] | 12.2 | 8.87 |
| FRAME PERIOD [ms] | 20.0 | 16.7 |

FIG. 8 (a)
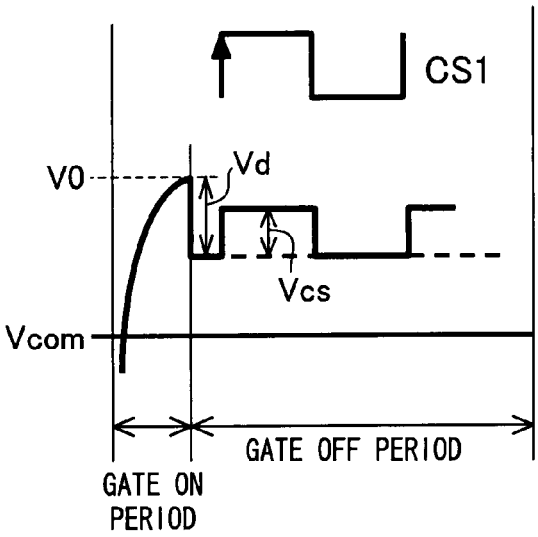
FIG. 8 (b)
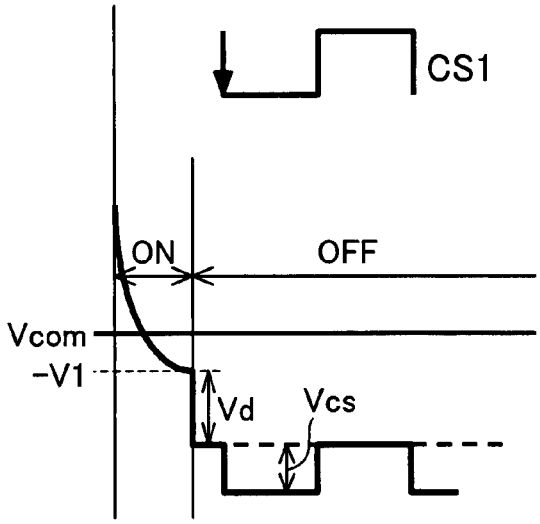
FIG. 8 (c)
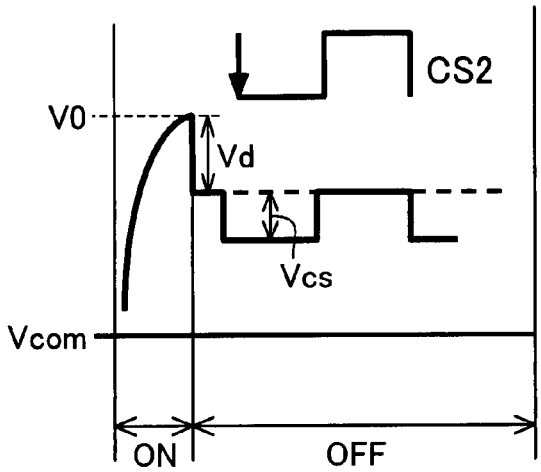
FIG. 8 (d)
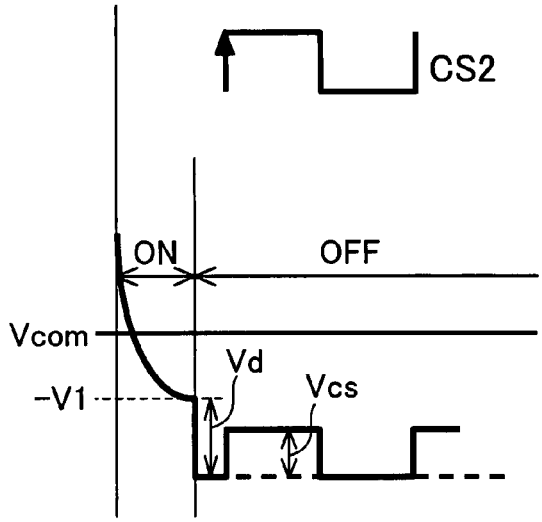
FIG. 8 (e)
| | | |
|---|---|---|
| BRIGHT PIXEL | + : ↑ | − : ↓ |
| DARK PIXEL | + : ↓ | − : ↑ |

DRIVE UNIT AND DISPLAY DEVICE FOR SETTING A SUBFRAME PERIOD

TECHNICAL FIELD

The present invention relates to a drive unit and a signal processing device for use in a display device which performs time division driving.

BACKGROUND ART

Liquid crystal display devices, which can reduce power requirements in driving, are widely used as not only portable devices but also stationary video display devices. In the liquid crystal display devices, digital data corresponding to gray-scale of each pixel in a display panel is supplied to a data signal line drive circuit. The data signal line drive circuit applies to a data signal line a potential of an analogue signal corresponding to a value of the digital data, thereby controlling luminance of each pixel.

The liquid crystal display devices generally adopt hold display in which writing is performed once during one frame period (i.e. all gate lines are turned on only once during one frame period), and a written state is maintained until a next frame comes. However, such a hold display gives rise to the problem that blurring in a moving image is likely to occur. In order to solve the problem, there has been proposed a method in which one frame is divided so that a potential of a signal is written to each pixel more than once during one frame period (time-division driving, see Patent documents 1 and 2, for example). In the time-division driving, one frame period is divided into sub-frames at a predetermined ratio (e.g. 1:1) and display luminance of one frame is expressed by a temporal sum of display luminances of the respective sub-frames.

[Patent Document 1]

Japanese Unexamined Patent Publication No. 68221/1993 (Tokukaihei 5-68221; Mar. 19, 1993)

[Patent Document 2]

Japanese Unexamined Patent Publication No. 296841/2001 (Tokukai 2001-296841; Oct. 26, 2001)

DISCLOSURE OF INVENTION

Assuming one frame is divided into two sub-frames and a ratio of the sub-frame periods is 1:1, one sub-frame period varies as follows. In the case of an input video signal having a frequency of 50 Hz as in the PAL (20 ms of one frame period), one sub-frame period is 10 ms. In the case of an input video signal having a frequency of 60 Hz as in the NTSC (16.6 ms of one frame period), one sub-frame period is 8.3 ms. In the case of an input video signal having a frequency of 24 Hz (42 ms of one frame period) as in a DVD movie, one sub-frame period is 21 ms. In addition to change of the type of input video signal, the number of total (scanning) lines in one frame can be changed by a user (e.g. a manufacturer of television set) as required.

With change of the length of a sub-frame period, a temporal sum of luminance of each pixel in a sub-frame changes. For this reason, when driving is performed in the same manner with respect to input video signals of various specifications, deviation in displaying occurs depending upon the type (specification) of an input video signal. Especially in the liquid crystal display devices, a response speed of liquid crystal is relatively slow. This makes it difficult to control a response of sub-frames in a frame period that varies. When the length of a frame period (sub-frame period) increases depending upon the type of input video data and a sub-frame period exceeds a given value (e.g. 8 ms), switching between sub-frames is recognized by a user (viewer). This causes the user to perceive flickers. In the meanwhile, cost increases when required driving design matters can be changed according to input video signals of various specifications and for user convenience.

In view of the above problem, the present invention provides a drive unit of a display device which performs time-division driving, in which no variations in display quality occurs with respect to various kinds of input video signals.

In order to solve the above problem, a drive unit of a display device according to the present invention is a drive unit of a display device, the drive unit driving a display device in which one frame is divided into a plurality of sub-frames so that display of input video data is realized by summation of displays of the sub-frames, the drive unit including: a sub-frame data generating section generating sets of sub-frame data corresponding to the respective sub-frames; and a sub-frame period fixing section setting at least one sub-frame period (time) to a given value regardless of a type of the input video data.

According to the above arrangement, it is possible to fix a period of a predetermined sub-frame regardless of the type of input video data (e.g. PAL and NTSC). Thus, it is possible to avoid display variations that occur depending upon the type of input video data (or uneconomical conditions in which arrangements corresponding to the respective sets of input video data are prepared).

A sub-frame as a setting (fixing) target is determined on the basis of the nature of every device, a driving method (how many sub-frames one frame is divided into and other methods), and visual characteristics (sub-frame period which causes flickers and other characteristics). It should be noted that which sub-frame a setting target is may be determined in advance or may be arranged to be changeable (according to the type of input video data or other condition).

A drive unit of a display device according to the present invention is a drive unit of a display device, the drive unit driving a display device in which one frame is divided into a plurality of sub-frames, and display of input video data is realized by summation of displays of the sub-frames, the drive unit comprising: a sub-frame data generating section generating sets of sub-frame data corresponding to be the respective sub-frames; and a sub-frame period fixing section setting a sub-frame period of a predetermined sub-frame to be not higher than a predetermined value which is determined on the basis of human visual characteristics.

According to the above arrangement, in performing time-division driving using sub-frames, a sub-frame period of a predetermined sub-frame can be set to be not higher than a predetermined value which is determined on the basis of human visual characteristics. Therefore, for example, by setting the predetermined value to be a minimum value during which human can recognize switching between sub-frames, it is possible to enhance moving image display characteristics and reduce flickers or the like.

In the drive unit of a display device, it is preferable that the predetermined value is a minimum time which causes switching between sub-frames including the predetermined sub-frame (switching from a sub-frame as a setting target to another sub-frame, and vice versa) to be recognizable.

According to the above arrangement, existence of sub-frames in a frame is not recognize by a viewer. This reduces flickers or the like. More specifically, the minimum time should be set to 8 ms. For example, in a case where one sub-frame is divided into two, a sub-frame of 8 ms is not recognized, and switching between a first sub-frame and a second sub-frame is not therefore recognized.

The sub-frame period setting section may set a sub-frame period which is a setting target to a given value which satisfies the foregoing condition, regardless of a type of the input image data. This eliminates the need for individual setting of a sub-frame period according to the type of input video data.

A sub-frame as a setting (fixing) target is determined on the basis of the nature of every device, a driving method (how many sub-frames one frame is divided into and other methods), and visual characteristics (sub-frame period which causes flickers and other characteristics). It should be noted that which sub-frame a setting target is may be determined in advance or may be arranged to be changeable (according to the type of input video data or other condition).

The present drive unit of a display device may be such that the sub-frame period fixing section includes a fixed clock generating section which generates a fixed clock, and the sub-frame data generating section uses the fixed clock as a dot clock regardless of a type of the input video image.

According to the above arrangement, a dot clock is fixed regardless of the type of input video data. Therefore, a sub-frame period of a target sub-frame can be conveniently fixed only by setting Vtotal and Htotal.

The present drive unit of a display device may be such that the sub-frame period fixing section sets the number of lines scanned in a sub-frame as a setting target (a sub-frame period to be fixed) to a fixed value regardless of a type of the input video data. According to the above arrangement, Vtotal of a sub-frame as a setting target is fixed regardless of the type of input video data. Therefore, a sub-frame period of a target sub-frame can be conveniently fixed only by setting its Htotal or dot clock.

The present drive unit of a display device may be such that the sub-frame period fixing section sets the number of dots of one line for a sub-frame as a setting target (a sub-frame period to be fixed) to a given (fixed) value regardless of a type of the input video data.

According to the above arrangement, Htotal of a sub-frame as a setting target is fixed regardless of the type of input video data. Therefore, a sub-frame period of a target sub-frame can be conveniently fixed only by setting its Vtotal or dot clock.

In the present drive unit of a display device, it is preferable that the sub-frame period fixing section changes the number of dots of one line in a sub-frame other than the sub-frame as a setting target (a sub-frame period to be fixed), according to the input video data. To fix a predetermined sub-frame period regardless of input video data, it is necessary to adjust a sub-frame period other than the setting target. This requires change of at least a dot clock and one of Vtotal and Htotal of a sub-frame other than the setting target. However, in terms of design and expansion of a device, it is preferable to fix a dot clock and Vtotal (see the following descriptions). For this reason, in the present invention, Htotal (dot) of a sub-frame other than the setting target is therefore changed.

The present drive unit of a display device may be such that at a stage prior to the sub-frame data generating section, a correction section is provided which corrects present input video data in accordance with previous input video data and the present input video data. Further, at a stage subsequent to the sub-frame data generating section, a correction section may be provided which corrects current sub-frame data in accordance with previous sub-frame data and the current sub-frame data.

For example, assume that present input video data is corrected in accordance with previous input video data to perform grayscale transition emphasis. In this case, when a predetermined sub-frame period is constant (fixed) as in the above arrangement, it is possible to perform grayscale transition with accuracy regardless of a type of input video data (or to avoid uneconomical conditions in which settings of grayscale transition emphasis which settings are changed corresponding to the respective sets of input video data are prepared).

It is preferable that the present drive unit of a display device divides one frame into two sub-frames, wherein the sub-frame data generating section generates first sub-frame data and second sub-frame data corresponding to a first sub-frame and a second sub-frame, respectively, so that for low luminance display, a grayscale of the first sub-frame data is set to a value close to a minimum value, and a grayscale of the second sub-frame data is changed, whereas for high luminance display, a grayscale of the first sub-frame data is changed, and a grayscale of the second sub-frame data is set to a value close to a maximum value.

According to the above arrangement, the first sub-frame is dark display frame and the second sub-frame is bright display frame. This makes it possible to perform time-division display by making the best use of grayscales close to minimum and maximum grayscales in each of the sub-frames. This can brings the above-mentioned effect and effectively reduces blurring of a moving image and whitish appearance in a predetermined grayscale region.

In the present drive unit of a display device, it is preferable that the sub-frame period fixing section sets a period of the first sub-frame to a given period.

According to the present arrangement, for example, by fixing a sub-frame period of the first sub-frame in which display appears dark to a value not higher than a predetermined value (e.g. 8.0 ms), it is possible to prevent only the sub-frame in which display appears dark from being perceived. This eliminates flickers regardless of the type of input video data.

The present drive unit of a display device is preferably such that in driving a display device in which each pixel has a first sub-pixel and a second sub-pixel that are connected to a same source line and a same gate line, alternating potentials applied to auxiliary capacity lines, which are connected to the respective sub-pixels, control the first sub-pixel and the second sub-pixel so that the first sub-pixel and the second sub-pixel provide displays with different luminances with respect to one display data, and one frame is divided into two sub-frames so that display of input video data is realized by summation of displays of the first and second sub-frames, the sub-frame period fixing section sets a total line to a given value regardless of a type of the input video data, the total line being a sum of (i) the number of lines scanned in the first sub-frame and (ii) the number of lines scanned in the second sub-frame, and a cycle of an alternating potential applied to the auxiliary capacity line is an integral multiple of one line period, and a total line period of the first and second sub-frames is (2n+1) times a half cycle of the alternating potential.

According to the above arrangement, since a sum of Vtotal (number of lines) of the first sub-frame and Vtotal (number of lines) of the second sub-frame is a fixed value even when a frame period changes according to various kinds of input signals (e.g. 16.6 ms and 20 ms), the potential of the auxiliary capacity line is phase shifted by 180° ($\pi$) in one frame and, the polarity of a potential of the auxiliary capacity line is reversed in each frame.

A display device of the present invention includes: the above-mentioned drive unit of a display device; and a display section including pixels driven by the drive unit.

Further, the display device of the present invention further includes image receiving means which receives television broadcast and supplies, to the drive unit of the display device, a video signal indicating an image transmitted by the television broadcast, the display device being a liquid crystal display panel, wherein the display device functions as a liquid crystal television receiver.

Still further, the display device of the present invention is such that the display section is a liquid crystal display panel, the drive unit of the display device receives a video signal from outside, and the display device functions as a liquid crystal monitor device which displays an image indicated by the video signal.

As described above, according to the drive unit of a display device of the present invention, it is possible to restrain display variations caused by change of the type of input video data or other event in operating the display device by time-division driving. Moreover, according to the drive unit of a display device of the present invention, it is possible to reduce the occurrence of flickers caused by change of the type of input video data or other event in operating the display device by time-division driving.

BRIEF DESCRIPTION OF DRAWINGS

FIG. 5 is an explanatory view of LUTs for data of sub-frames according to First Embodiment.

FIG. 6 is a table showing an example of design of sub-frame periods according to First and Second Embodiments.

FIG. 8(*a*) is a graph showing a voltage (liquid crystal voltage) applied to the liquid crystal capacity of a sub-pixel when a positive (≧Vcom) display signal is applied to a source line S.

FIG. 8(*b*) is a graph showing a voltage (liquid crystal voltage) applied to the liquid crystal capacity of a sub-pixel when a negative (≦Vcom) display signal is applied to a source line S.

FIG. 8(*c*) is a graph showing a voltage (liquid crystal voltage) applied to the liquid crystal capacity of a sub-pixel when a positive (≧Vcom) display signal is applied to a source line S.

FIG. 8(*d*) is a graph showing a voltage (liquid crystal voltage) applied to the liquid crystal capacity of a sub-pixel when a negative (≦Vcom) display signal is applied to a source line S.

FIG. 8(*e*) is a table showing (i) the polarities of respective liquid crystal voltages supplied to a sub-pixel (bright pixel) with high luminance and a sub-pixel (dark pixel) with low luminance and (ii) the states of auxiliary signals immediately after the gate drawing.

FIG. 10(*b*) is a graph showing a liquid crystal voltage in a sub-pixel (bright pixel) whose luminance increases in the pixel division driving.

FIG. 10(*c*) is a graph showing a liquid crystal voltage in a sub-pixel (dark pixel) whose luminance decreases in the pixel division driving.

FIG. 11(*b*) is a graph showing the luminance of the bright pixel and the dark pixel of FIG. 10(*c*).

FIG. 12(*b*) is a graph showing the luminance of the dark pixel in case where polarity reversal is carried out in each frame.

FIG. 14(*b*) is a graph showing the luminance of a dark pixel in case where polarity reversal is carried out in a sub frame cycle.

FIG. 20(*b*) is a block diagram illustrating the structure of a substantial part of a liquid crystal monitor device including the present liquid crystal display device.

BEST MODE FOR CARRYING OUT THE INVENTION

The following will describe an embodiment of the present invention with reference to FIGS. 1 through 20.

A liquid crystal display device of the present invention is preferably used as a display device of a television receiver, for example. Examples of television broadcasts received by the television receiver include a terrestrial television broadcast, a satellite broadcast, such as a BS (Broadcasting Satellite) digital broadcast and a CS (Communication Satellite) digital broadcast, and a cable television broadcast.

Figure 15:
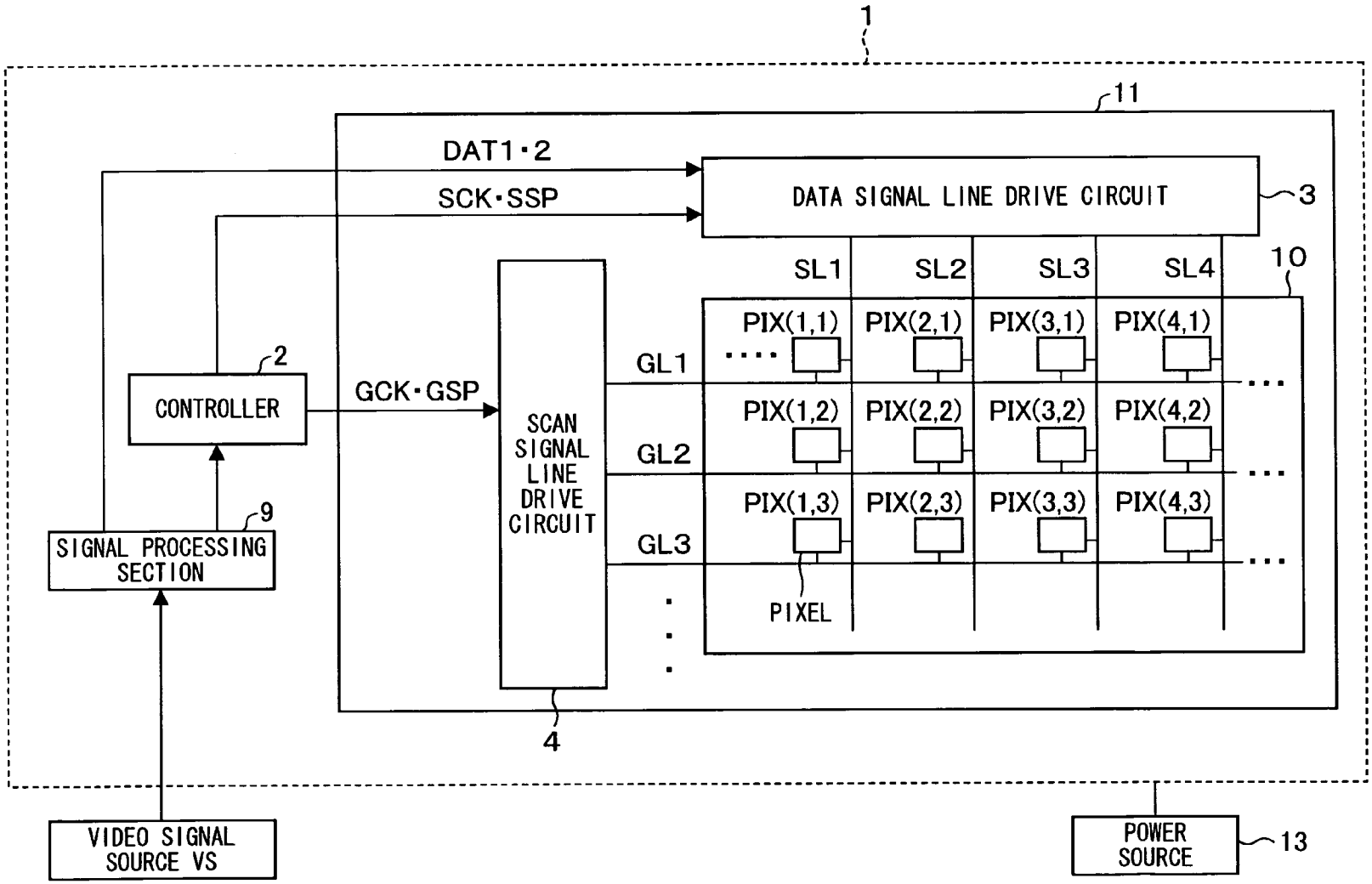
FIG. 15 is a diagram schematically illustrating the structure of a liquid crystal display device according to First and Second Embodiments.

As illustrated in FIG. 15, a liquid crystal display device 1 (display device) of the present invention includes a panel 11, a controller 2, a signal processing section 9, and a power source 13. The panel 11 includes a pixel array 10 (display section), a data signal line drive circuit 3, and a scan signal line drive circuit 4. The pixel array 10 has pixels PIX (1, 1) through PIX (n, m) arranged in a matrix manner.

The signal processing section 9 generates display data DAT1 of a first sub-frame and display data DAT2 of a second sub-frame on the basis of input video data D1 supplied from a video signal source VS, and outputs the data to the data signal line drive circuit 3.

Figure 20:
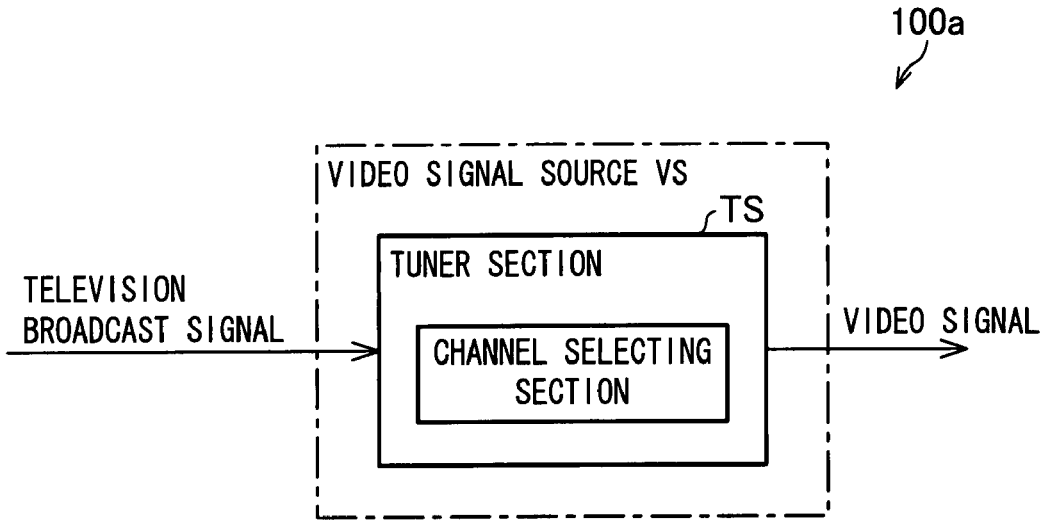
FIG. 20(*a*) is a block diagram illustrating the structure of a substantial part of a television receiver including the present liquid crystal display device.
Figure 20:
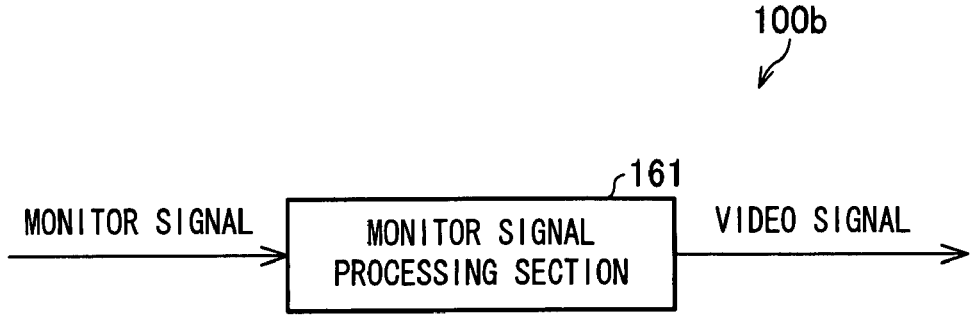

The video signal source VS may be any device if the device is able to generate the input video data. As illustrated in FIG. 20(*a*), a television receiver 100*a* including the liquid crystal display device 1 is provided with a video signal source VS and the liquid crystal display device 1. For example, a television broadcast signal is supplied to the video signal source VS. The video signal source VS further includes a tuner section TS. The tuner section TS selects a channel based on the television broadcast signal and then outputs, as input video data, a television video signal of a selected channel to the signal processing section 9.

As illustrated in FIG. 20(*b*), a liquid crystal monitor device 100*b* including the liquid crystal display device 1 is provided with a monitor signal processing section 161. The monitor signal processing section 161 receives a monitor signal of a video supplied from a personal computer or the like, for example, and outputs a video signal to the panel 11. Note that the monitor signal processing section 161 may include the signal processing section 9 or may be provided at the stage prior or subsequent to the signal processing section 9.

The panel 11 is a panel capable of performing color display by controlling luminance of pixels which constitute a pixel and are able to display colors R, G, B, for example. As illustrated in FIG. 15, scan signal lines GL1 through GLm and data signal lines SL1 through SLn are provided in the pixel array 10. In the vicinities of intersections of the both lines, pixels PIX (1, 1) through PIX (n, m) are arranged in a matrix manner. Here, the data signal line drive circuit 3 drives the data signal lines SL1 through SLn. Further, the scan signal line drive circuit 4 drives the scan signal lines GL1 through GLm.

Note that the above-mentioned sections and circuits operate with power supplied from the power source 13. In the present embodiment, one pixel PIX is constituted by three pixels PIX which are adjacent to each other along the scan signal lines GL1 through GLm.

First of all, the general structure and operation of the liquid crystal display device 1 as a whole will be described. For convenience, reference numerals have an alphanumeric suffix identifying the individual member's position, as in "SLi" referring to the i-th data signal line, only when necessary; the suffixes are omitted when not necessary or when numerals refer collectively to a group of identical members.

The pixel array 10 is made up of multiple (n in this example) data signal lines SL1-SLn and the multiple (m in this example) scan signal lines GL1-GLm provided to cross the data signal lines SL1-SLn. A pixel PIX(i, j) is provided for each combination of a data signal line SLi and a scan signal line GLj, where i is an integer from 1 to n and j is an integer from 1 to m.

Figure 16:
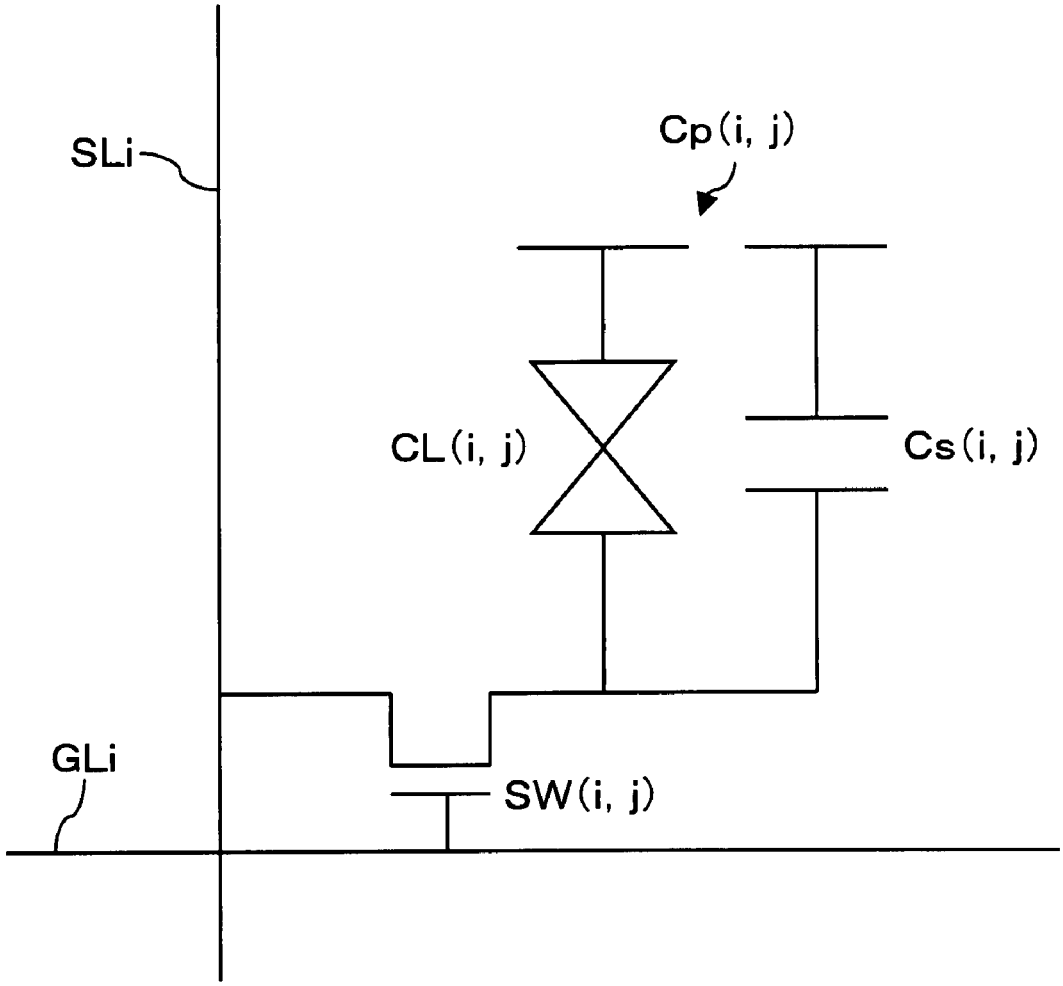
FIG. 16 is a view illustrating the structure of part of the liquid crystal display device illustrated in FIG. 15.

In the present embodiment, as illustrated in FIGS. 15 and 16, each pixel PIX(i, j) is surrounded by two adjacent data signal lines SL(i−1), SLi and two adjacent scan signal lines GL(j−1), GLj. The pixel PIX(i, j) includes a field effect transistor SW(i, j) acting as a switching device, with the gate and drain connected respectively to the scan signal line GLj and data signal line SLi. The pixel PIX(i, j) further includes a pixel capacitor Cp(i, j), an electrode of which is connected to the source of the field effect transistor SW(i, j); the other electrode connected to a common electrode line shared by all the pixels PIX. The pixel capacitor Cp(i, j) is constructed from a liquid crystal capacitance CL(i, j), and an auxiliary capacitance Cs(i, j) is added where necessary.

The pixel PIX(i, j) operate as follows: Selecting the scan signal line GLj turns on the field effect transistor SW(i, j), causing the voltage on the data signal line SLi to appear across the pixel capacitor Cp(i, j). Then, the scan signal line GLj is deselected to turn off the field effect transistor SW(i, j), causing the pixel capacitor Cp(i, j) to retain the voltage at the turn off. Since liquid crystal transmittance and reflectance vary depending on the voltage across the liquid crystal capacitance CL(i, j), the display state of the pixel PIX(i, j) changes according to display data DAT(i, j, k) if a voltage is applied to the data signal line SLi in accordance with the display data DAT (i, j, k) while the scan signal line GLj is being selected.

The liquid crystal display device according to the present embodiment uses liquid crystal cells of vertical align mode. With no voltage applied, liquid crystal molecules are aligned substantially vertical to the substrate. The liquid crystal molecules incline off the vertical align state in accordance with the voltage across the liquid crystal capacitance CL(i, j) of the pixel PIX(i, j). In the liquid crystal display device according to the present embodiment, the liquid crystal cells of vertical align mode are used in 'normally black mode' (the display appears black under no voltage application).

Referring now to FIG. 15, the scan signal line drive circuit 4 feeds the scan signal lines GL1-GLm with a signal indicative of a select period, such as a voltage signal. The scan signal line drive circuit 4 selects the scan signal line GLj to which to supply the select period signal, according to a clock signal GCK, a start pulse signal GSP, and other timing signals from the controller 2. The scan signal lines GL1-GLm are hence sequentially selected at predetermined timings.

The data signal line drive circuit 3 outputs signals to the data signal lines SL1-SLn in accordance with the respective display data. The lines SL1-SLn then pass on the signals to the pixels PIX(1, j) to PIX(n, j) which are being selected through the scan signal line GLj by the scan signal line drive circuit 4. At this time, the data signal line drive circuit 3 D/A converts the display data (DAT1 and DAT2) outputted from the signal processing section 9 and writes analogue signal potentials to the data signal lines SL1-SLn.

The data signal line drive circuit 3 determines output timings for the samplings and signal outputs according to a clock signal SCK, a start pulse signal SSP, and other timing signals fed from the controller 2.

The brightness of the pixels PIX(1, j) to PIX(n, j) is changed through the respective signals fed to the data signal lines SL1-SLn by adjusting projected light quantity, transmittance, and others, while the corresponding scan signal line GLj is being selected.

With the scan signal lines GL1-GLm sequentially selected by the scan signal line drive circuit 4, the pixels PIX(1, 1) to PIX(n, m) of the pixel array 10 are set to the brightness (grayscale level) indicated by the respective data, allowing for an update of the video image displayed by the pixel array 10.

With the liquid crystal display device, the input video data supplied from the video signal source VS to the signal processing section 9 may be an analogue signal or a digital signal. Further, the input video signal may be transferred frame by frame (for each entire screen). Alternatively, each frame may be divided up into fields, and the input video data may be transferred a field at a time. The following description is explained where digital input video data is transferred frame by frame, as an example. More specifically, in the present embodiment, to transfer the input video data through the video signal line to the signal processing section 9 in the liquid crystal display device 1, the video signal source VS transfers video data for a complete frame, before transferring video data for a next frame. Video data are thus transferred by time division in each frame.

In the present embodiment, video data indicative of colors of pixels (e.g. data indicative of RGB), for example, are sequentially transferred, and the signal processing section 9 generates display data (DAT1 and DAT2) to be supplied to each pixel on the basis of input video data for each pixel.

The display data (DAT1 and DAT2) is constituted by sets of display data after the processes, which are supplied to the respective pixels. A set of display data supplied to each pixel in a frame is constituted by sets of display data supplied to each pixel in the respective sub-frames. In the present embodiment, the sets of video data constituting the display data DAT1 and DAT2 are also supplied by time division.

More specifically, to transfer the display data DAT1 and DAT2, the signal processing section 9 transfers display data DAT1 and DAT2 for a complete frame, before transferring display data DAT1 and DAT2 for a next frame. Video data may thus transferred by time division in each frame. Each frame is made up of two sub-frames (first and second sub-frames). For example, the signal processing section 9 transfers display data DAT1 for the first sub-frame, before transferring display data DAT2 for the second sub-frame to be transferred next.

The following will describe details of the signal processing section 9 and a modified example thereof.

First Embodiment

The following will describe First Embodiment of the present invention with reference to FIGS. 1, 6, 15, 16, and others.

Figure 1:
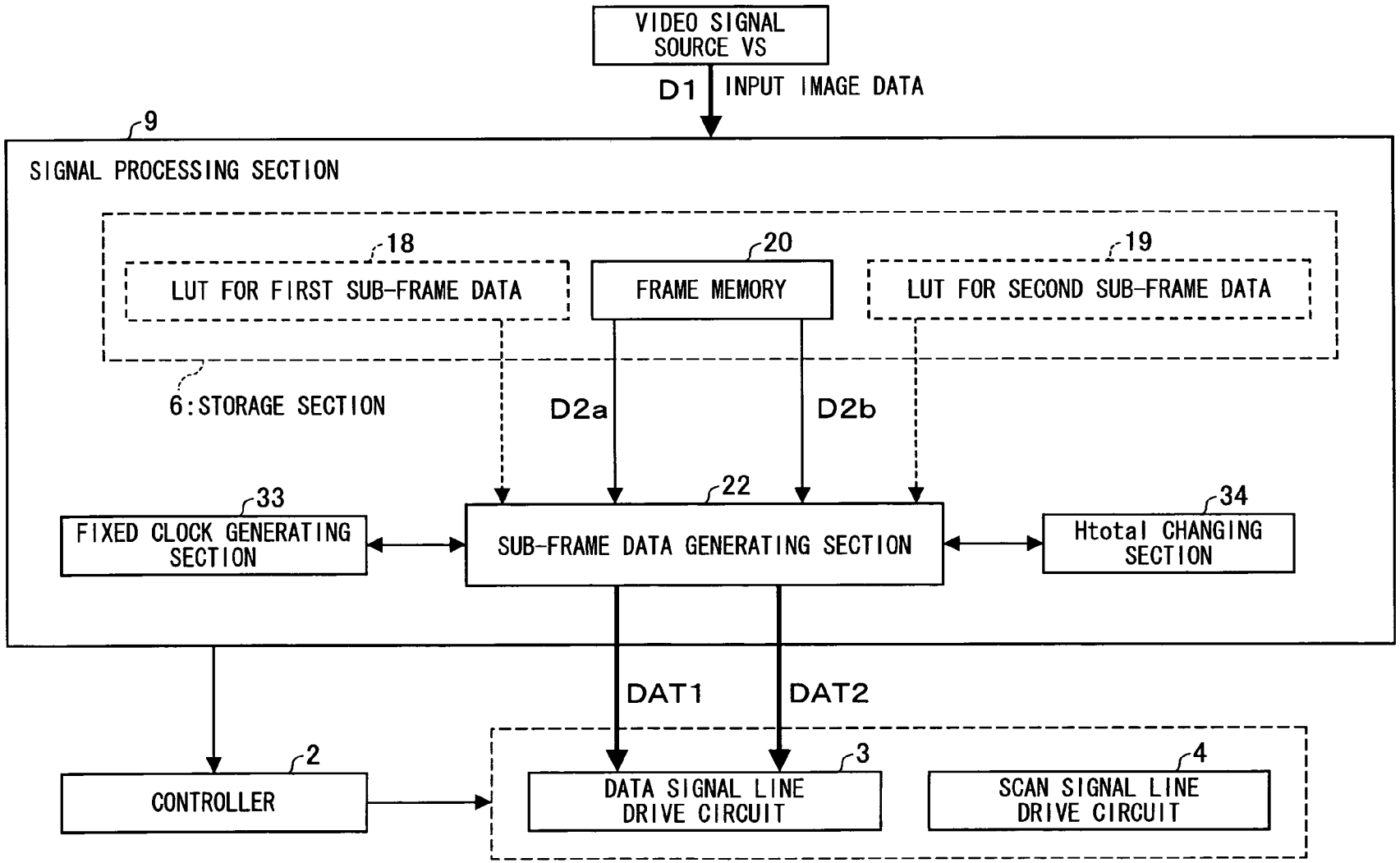
FIG. 1 is a block diagram illustrating a signal processing section according to First Embodiment.

As illustrated in FIGS. 1 and 15, the signal processing section 9 of the liquid crystal display device 1 includes a storage section 6, a sub-frame data generating section 22, a fixed clock generating section 33 (sub-frame period fixing section), and a Htotal changing section 34 (sub-frame period fixing section).

The storage section 6 stores therein an LUT 18 for first sub-frame data and an LUT 19 for second sub-frame data. The storage section 6 further includes a frame memory 20 that stores data D2 frame by frame. The sub-frame data generating section 22 sequentially read out the data D2 in accordance with an internal clock generated by the fixed clock generating section 33.

The fixed clock generating section 33 generates a specific clock. Regardless of the type (specification) of an input signal, the sub-frame data generating section 22 reads out input video data which is once stored in the frame memory 20 in accordance with the specific clock. The Htotal changing section 34 changes Htotal (dot) of a second sub-frame according to the input video data.

As illustrated in FIG. 1, the sub-frame data generating section 22 reads out twice the input video data (data D1) which is stored in the frame memory 20 in accordance with the specific clock to obtain data D2*a* and data D2*b*. Then, the sub-frame data generating section 22 generates first sub-frame data DAT1 from the data D2*a*, which was read out at the first readout, and the LUT 18 for first sub-frame data, and generates second sub-frame data DAT2 from the data D2*b*, which was read out at the second readout, and the LUT 19 for second sub-frame data.

In the present embodiment, data D2*a* and data D2*b* are read out in accordance with a fixed dot clock Dcf (e.g. 130 MHz) which is generated by the fixed clock generating section 33, regardless of the type of an input signal. Further, Vtotal of the first sub-frame data and Vtotal of the second sub-frame are set respectively to specific values Vα (e.g. 820 lines) and Vβ (e.g. 830 lines), regardless of the type of an input signal. Htotal of the first sub-frame is set to a specific value Hα (dot), whereas Htotal (number of dots) of the second sub-frame is made variable by the Htotal changing section 34.

With this arrangement, the first sub-frame period takes a constant value obtained by the equation (1/Dcf)×Vα×Hα, regardless of the type (frequency) of an input signal. With this, the first sub-frame periods become identical (specific) even when different input signals (frequencies of input signals) come, and it is therefore possible to prevent display variations, which are caused by input signals of different types (frequencies).

Htotal of the second sub-frame is changed as previously described to adjust difference in length of a frame period which different is caused by different input signals. When an input signal (Htotal of the second sub-frame=Ht) of a frequency Fin and an input signal (Htotal of the second sub-frame=Ht') of a frequency F'in are considered, the following equations are obtained.

$$1/F\text{in (one frame period)}=(1/Dcf)\times V\alpha\times H\alpha+(1/Dcf)\times V\beta\times Ht$$

$$1/F'\text{in (one frame period)}=(1/Dcf)\times V\alpha\times H\alpha+(1/Dcf)\times V\beta\times Ht'$$

Hence, difference in frame period between the two input signals is expressed by the following equation.

$$Tx[s]=(1/F\text{in})-(1/F'\text{in})=(1/Dcf)\times V\beta\times(Ht-Ht')$$

Therefore, (Ht−Ht')=Dcf×Tx/Vβ. In other words, if there is difference of TX[s] in one frame period between two input signals, difference of Dcf×Tx/Vβ dots should be set between Htotal values of their second sub-frames.

FIG. 6 shows a specific example of settings. In FIG. 6, Dcf is 130 MHz, Vα is 820, Vβ is 830, and Hα=1236 (dots). For an input signal A of 60 Hz-frequency (e.g. NTSC), Htotal of the second sub-frame is 1388 (dots). For an input signal B of 50 Hz-frequency (e.g. PAL), Htotal of the second sub-frame is 1910 (dots).

In this case, regarding the input signal A (60 Hz), the first sub-frame period (dark display period) is 7.80 ms and the second sub-frame period (bright display period) is 8.87 ms. Regarding the input signal B (50 Hz), the first sub-frame period (dark display period) is 7.80 ms and the second sub-frame period (bright display period) is 12.2 ms.

According to the present embodiment, it is possible to fix a period (dark display period) of a predetermined sub-frame (first sub-frame) (e.g. 7.8 ms), regardless of the type of input video data (e.g. PAL and NTSC). Accordingly, it is possible to avoid display variations that occur depending upon the type of input video data (or uneconomical conditions in which arrangements corresponding to the respective sets of input video data are prepared). In addition, when the first sub-frame period is set to 8.0 ms or lower, switching from the first sub-frame to the second sub-frame is not perceived. This makes it possible to prevent flickers. Moreover, when the first sub-frame period of the first sub-frame in which display appears dark to 8.0 ms or lower, it is possible to prevent only the sub-frame in which display appears dark from being perceived. This makes it possible to realize a flicker-free display, regardless of the type of input video data.

Referring back to FIG. 1, the controller 2 controls the data signal line drive circuit 3 so that the data signal lines SL1 are driven by the above-mentioned specific dot clock Dcf. The Htotal changing section 34 changes Htotal (number of dots) of the second sub-frame according to the type or the like of an input signal. It is preferable that the number of dots is changed by changing settings on a timing counter. This makes it possible to easily change Htotal (number of dots).

The LUT 18 for first sub-frame data and the LUT 19 for second sub-frame data are provided respectively corresponding to the first sub-frame and the second sub-frame. As illustrated in FIG. 5, the LUTs 18 and 19 are tables in which grayscale (input grayscale, 8 bits) of data D2*a* (D2*b*) is combined with grayscale (output grayscale, 8 bits) of data DAT1 (DAT2).

As illustrated in FIG. 5, in the LUT 18 for first sub-frame data, output grayscale of Gmin (0 grayscale level or approximately 0 grayscale level) is set for input grayscale ranging from the lowest luminance of 0 to the second intermediate luminance L2 through the first intermediate luminance L1. On the other hand, output grayscale of Gmin to Gmax (0 grayscale level or approximately 0 grayscale level) is set for input grayscale ranging from the second intermediate luminance L2 to the highest luminance (255 grayscale) through the third intermediate luminance L3.

In the LUT 19 for second sub-frame data, output grayscale is increased from Gmin to Gmax for input grayscale ranging from the lowest luminance of 0 to the second intermediate luminance L2 through the first intermediate luminance L1. On the other hand, output grayscale of Gmax (approximately 255 grayscale level) is set for input grayscale ranging from the second intermediate luminance L2 to the highest luminance (255 grayscale) through the third intermediate luminance L3.

For example, assume that data D2*a* and D2*b* (input grayscale) corresponding to a pixel are Gx. In this case, display data DAT1 of the first sub-frame is Gp and display data DAT2 of the second sub-frame is Gq. A temporal sum (time integral value) of display luminance levels corresponding to Gp and Gq equals to a display luminance level corresponding to Gx. This provides dark display for the first sub-frame and bright display for the second sub-frame.

The following will describe details of operations and effects of the sub-frame data generating section 22 according to the present embodiment.

The sub-frame data generating section 22 reads out sets of data D2*a* and D2*b* from the frame memory 20. The number of times the sub-frame data generating section 22 reads out in each frame corresponds to the number of sub-frames (twice in this case). In association with possible values of sets of data D2*a* thus read out, the LUT 18 for the first sub-frame data (hereinafter referred to as LUT 18) stores values indicating sets of data DAT1 each of which is outputted when the data D2*a* has the corresponding value. Similarly, in association with the possible values, the LUT 19 for the second sub-frame data (hereinafter referred to as LUT 19) stores values indicating sets of data DAT2 each of which is outputted when the data D2*b* has the corresponding value. Referring to the LUT 18, the sub-frame data generating section 22 can output data DAT1 corresponding to the D2*a* thus read out. Also, referring to the LUT 19, the sub-frame data generating section 22 outputs data DAT2 corresponding to the D2*b* thus read out.

The values stored in the LUTs 18 and 19 may be differences from the possible values, on condition that the sets of data DAT1 and DAT2 to be outputted can be specified. In the present embodiment, the values of the sets of data DAT1 and DAT2 are stored, and the sub-frame data generating section 22 outputs, as sets of data DAT1 and DAT2, the values read out from the LUTs 18 and 19. The values stored in the LUTs 18 and 19 are set as below, assuming that a possible value is g whereas stored values are P1 and P2. Although the data DAT1 for the first sub-frame may be set so as to have higher luminance, the following assumes that the data DAT2 for the second sub-frame has higher luminance than the data DAT1 for the first sub-frame.

In case where g indicates a grayscale not higher than a predetermined threshold (i.e. indicates luminance not higher than the luminance indicated by the threshold), the value P1 falls within a range determined for dark display, whereas the value P2 is set in accordance with the value P1 and the value g. The range for dark display is not higher than a predetermined grayscale for dark display. If the predetermined grayscale for dark display indicates the minimum luminance (black), the range is at the grayscale with the minimum luminance (i.e. black). The predetermined grayscale for dark display is preferably set so that below-mentioned whitish appearance is restrained to a desired amount or below. On the other hand, in case where g indicates a grayscale higher than a predetermined threshold (i.e. indicates higher luminance than the luminance indicated by the threshold), the value P2 is set so as to fall within a predetermined range for bright display whereas the value P1 is set in accordance with the value P2 and the value g.

The range for bright display is not lower than a predetermined grayscale for bright display. If the predetermined grayscale for bright display indicates the maximum luminance (white), the range is at the grayscale with the maximum luminance (i.e. white). The predetermined grayscale for bright display is preferably set so that below-mentioned whitish appearance is restrained to a desired amount or below. As a result, in case where the data D2 (input grayscale) supplied to the pixel PIX in a frame indicates a grayscale not higher than the aforesaid threshold, i.e., in a low luminance region, the magnitude of the luminance of the pixel PIX in the frame mainly depends on the magnitude of the value P2. On this account, the state of the pixel PIX is dark display, at least in the sub-frame period in the frame. Therefore, in case where the data D2 in a frame indicates a grayscale in a low luminance region, the pixel PIX in the frame can simulate impulse-type light emission typified by CRTs (Cathode-Ray Tubes), and hence the quality of moving images on the pixel array 10 is improved.

In case where the luminance of the data D2 (input grayscale) supplied to the pixel PIX in a frame is higher than the aforesaid threshold, i.e., in a high luminance region, the magnitude of the luminance of the pixel PIX in the frame mainly depends on the magnitude of the value P1. Therefore, in comparison with the arrangement in which the luminances of the respective sub frames are substantially equal, it is possible to greatly differentiate the luminance of the first sub-frame from the luminance of the second sub-frame. As a result, the pixel PIX in the frame can simulate impulse-type light emission in most cases, even if the data D2 in the frame indicates grayscale in a high luminance region. The quality of moving images on the pixel array 10 is therefore improved.

According to the arrangement above, in case where the data D2 indicates a grayscale in a high luminance region, the second sub-frame data DAT2 indicates a value within the range for bright display, and the value of the first sub-frame data DAT1 increases as the luminance indicated by the data D2 increases. Therefore, the luminance of the pixel PIX in the frame is high in comparison with an arrangement in which a period of dark display is always provided even when white display is required.

As a result, while the quality of moving images is improved because the pixel PIX simulates impulse-type light emission as above, the maximum value of the luminance of the pixel PIX is greatly increased. The liquid crystal image display device 1 can therefore produce brighter images. Incidentally, even in a VA panel which has a wide range of viewing angles, it is not possible to completely eliminate the variation in grayscale characteristics caused by a change in the viewing angle. For example, the grayscale characteristics deteriorate as, for example, a range of viewing angles in the horizontal direction is increased. For example, the grayscale gamma characteristic at the viewing angle of 60° is different from the grayscale gamma characteristic when the panel is viewed head-on (at the viewing angle of 0°), and hence whitish appearance, which is excessive brightness in intermediate luminance, occurs at the viewing angle of 60°.

Also in IPS-mode liquid crystal display panels, variations in grayscale characteristics occur more or less as a range of viewing angles is increased, although the variations depend on the design of an optical film in terms of optical properties. On the other hand, according to the arrangement above, one of the sets of sub-frame data DAT1 and DAT2 is set so as to fall within the range for dark display or within the range for bright display, both in case where the data D2 indicates a grayscale in a high luminance region and in case where the data D2 indicates a grayscale in a low luminance region. Also, the magnitude of the luminance of the pixel PIX in the frame mainly depends on the magnitude of the other data.

An amount of the whitish appearance (deviance from the desired luminance) is maximized around intermediate luminance, whereas an amount of the whitish appearance is relatively restrained when the luminance is sufficiently low or high. Therefore, a total amount of generated whitish appearance is greatly restrained in comparison with a case where both of the sub-frames are substantially equally varied so that the aforesaid luminance is controlled (i.e. intermediate luminance is attained in both sub-frames) and a case where an image is displayed without dividing a frame. It is therefore possible to greatly improve the viewing angle characteristics of the liquid crystal image display device 1.

Figure 19:
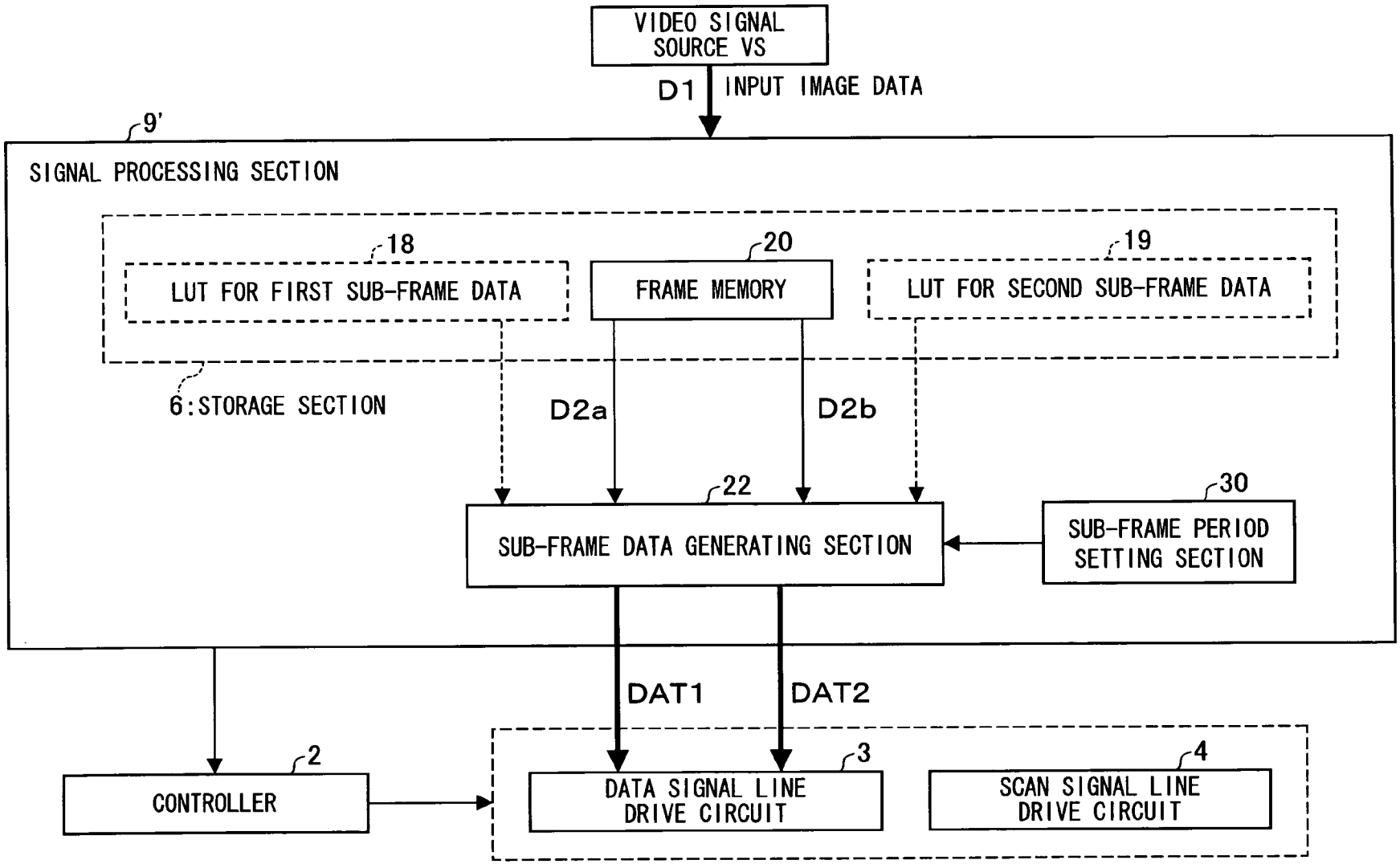
FIG. 19 is a block diagram illustrating a modified example of a signal processing section according to First Embodiment.

In the aforesaid arrangement, the first sub-frame period is fixed (e.g. a fixed value not higher than 8 ms) regardless of input video data. However, the first sub-frame period is not necessarily fixed. For example, as illustrated in FIG. 19, a signal processing section 9' may include a frame period setting section 30 which sets the first sub-frame period to a (variable) value not higher than a predetermined value (minimum time which causes switching between sub-frames including the predetermined sub-frame recognizable, e.g. 8 ms). In the present embodiment, 8 ms is adopted as the minimum time. This is because it has not been reported that 8 ms causes flickers in 60 Hz images on CRTs or the like as detrimental effects. Therefore, if flickers in 60 Hz images become a problem due to significant luminance increase of a display in the future (a frequency at which flickers are recognizable increases as luminance increases), the minimum time is set to 6.2 ms that corresponds to 80 Hz, for example. In this case, the same effects as the above-effects of the present embodiment are obtained.

Second Embodiment

Figure 2:
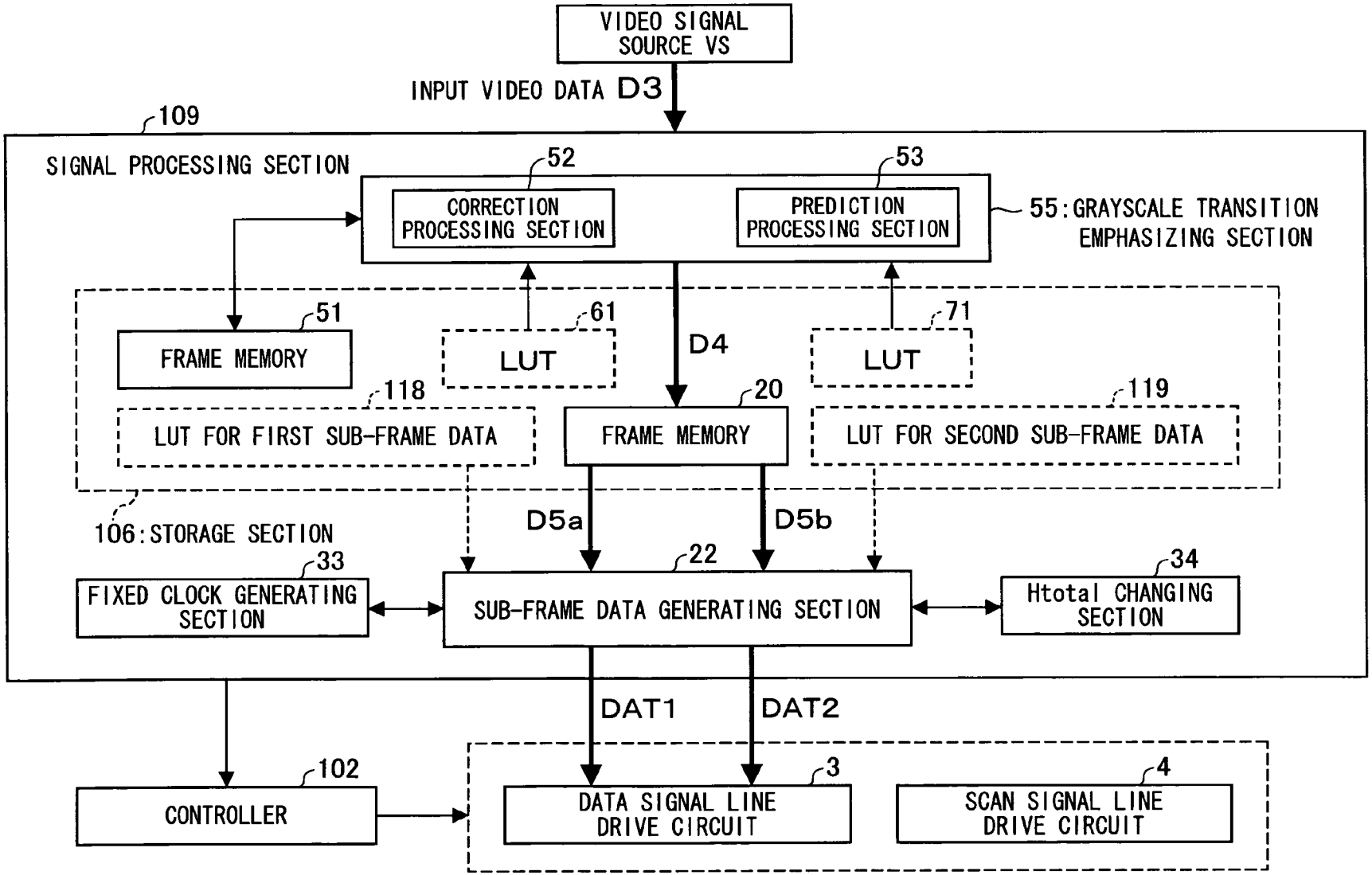
FIG. 2 is a block diagram illustrating a signal processing section according to Second Embodiment.

In the present embodiment, an arrangement in which grayscale transition is emphasized (overshoot driving) is described. As illustrated in FIG. 2, a signal processing section 109 of the present embodiment includes a grayscale transition emphasizing section 55. The grayscale transition emphasizing section 55 corrects data D3 supplied from a video signal source VS to emphasize grayscale transition of each pixel PIX, and outputs data D4 thus corrected. A sub-frame data generating section 22, a fixed clock generating section 33, and a Htotal changing section 34, which have the same functions as those in First Embodiment, give the same reference numerals.

More specifically, the sub-frame data generating section reads out data D4 from the frame memory 20 in accordance with a specific clock (Dcf) generated by the fixed clock generating section 33, and generates sets of data D5*a* and D5*b* for sub-frames. The Htotal changing section 34 determines Htotal of a second sub-frame according to the type of input video data D3, and then outputs a result of the determination to a controller 2.

In the present embodiment, for example, one frame is divided into two sub-frames. The sub-frame data generating section 22 outputs sets of data D5*a* and D5*b* in each frame, on the basis of frame data D4, a LUT 118 for first sub-frame data and a LUT 119 for second sub-frame data. The sets of data D5*a* and D5*b* correspond to the respective sub-frames of each frame. Since the grayscale transition emphasizing section 55 is provided, numeric values stored in the LUT 118 for first sub-frame data and the LUT 119 for second sub-frame data of a storage section 106 are different from those in the LUT 18 for first sub-frame data and the LUT 19 for second sub-frame data in First Embodiment.

Hereinafter, sub-frames constituting a frame are termed a first sub-frame (SFR1) and a second sub-frame (SFR2) which are temporally in this order.

The grayscale transition emphasizing section 55 performs a predictive grayscale transition emphasizing process, and includes: a frame memory 51 which stores a predicted value E of each pixel PIX until the next frame comes; a correction processing section 52 which corrects D3 of the current frame with reference to the predicted value E of the previous frame, which value has been stored in the frame memory 51, and outputs the corrected value as data D4; and a prediction processing section 53 which updates the predicted value E of the pixel PIX, which value has been stored in the frame memory 51, to a new predicted value E, with reference to the data D3 supplied to the pixel PIX in the current frame.

The predicted value E in the current frame indicates a value of a grayscale corresponding to predicted luminance to which the pixel PIX driven with the corrected data D4 is assumed to reach at the start of the next frame, i.e. when the pixel PIX starts to be driven with the data D4 in the next frame. Based on the predicted value E in the previous frame and the data D3 in the current frame, the prediction processing section 53 predicts the predicted value E.

As discussed above, the present embodiment is arranged as follows: frame division is conducted to corrected video data D4 so that two sets of video data D5*a* and D5*b* are generated for one frame, and voltages V1 and V2 corresponding to the respective sets of data are applied to the pixel PIX within one frame period. It should be noted that, as discussed below, corrected video data D4 is specified by specifying a predicted value E in the previous frame and data D3 in the current frame, and the sets of video data D5*a* and D5*b* and the voltages V1 and V2 are specified by specifying the data D4.

Since the aforesaid predicted value E is a predicted value in the previous frame, the predicted value E indicates, from the perspective of the current frame, a grayscale corresponding to predicted luminance to which the pixel PIX is assumed to reach at the start of the current frame, i.e. indicates the display state of the pixel PIX at the start of the current frame. In case where the pixel PIX is a liquid crystal display element, the aforesaid predicted value also indicates the alignment of liquid crystal molecules in the pixel PIX.

Therefore, provided that the prediction by the prediction processing section 53 is accurate and the predicted value E of the previous frame has been accurately predicted, the prediction processing section 53 can precisely predict the aforesaid predicted value E based on the predicted value E of the previous frame and the video data D of the current frame.

In the meanwhile, the correction processing section 52 can correct data D3 in such a way as to emphasize the grayscale transition from the grayscale indicated by a predicted value E in the previous frame to the grayscale indicated by the data D3, based on (i) the video data D3 in the current frame and (ii) the predicted value E in the previous frame, i.e. the value indicating the display state of the pixel PIX at the start of the current frame.

The processing sections 52 and 53 may be constructed solely by LUTs, but the processing sections 52 and 53 of the present embodiment are constructed by using both, reference process and interpolation process of the LUTs.

More specifically, the correction processing section 52 of the present embodiment is provided with an LUT 61 in a storage section 106. The LUT 61 stores, in association with respective pairs of sets of data D3 and predicted values E, values of data D4 each of which is output when a corresponding pair is input.

The LUT 61 of the present embodiment stores only values corresponding to predetermined pairs, in order to reduce the storage capacity. In case where a pair which is not stored in the LUT 61 is input, a calculation section (not shown) provided in the correction processing section 52 reads out values corresponding pairs similar to the pair thus input, and performs interpolation of these values by conducting a predetermined calculation so as to figure out a value corresponding to the pair thus input.

Similarly, an LUT 71 provided in the prediction processing section 53 stores, in association with respective pairs of sets of data D3 and predicted values E, values each of which is output when a corresponding pair is input. The LUT 71 also stores values to be output (predicted values E) in a similar manner as above. Furthermore, as in the case above, pairs of values stored in the LUT 71 are limited to predetermined pairs, and a calculation section (not shown) of the prediction processing section 53 figures out a value corresponding to a pair thus input, by conducting an interpolation calculation with reference to the LUT 71.

In the arrangement above, the frame memory 51 stores not data D3 of the previous frame but a predicted value E. The correction processing section 52 corrects the video data D of the current frame with reference to the predicted value of the previous frame, i.e. a value indicating predicted display state of the pixel PIX at the start of the current frame. It is therefore possible to prevent inappropriate grayscale transition emphasis, even if transition from rise to decay frequently occurs as a result of improvement in the quality of moving images by simulating impulse-type light emission.

More specifically, in case where a pixel PIX with a slow response speed is adopted, grayscale transition from last but one sub-frame to last sub-frame is emphasized, the luminance of the pixel PIX at the end of the last sub-frame (i.e. the luminance at the start of the current sub frame) may not reach the luminance indicated by the data D5*a* and D5*b* in the first sub-frame. This occurs, for example, when a difference between grayscales is great and when a grayscale before grayscale transition emphasis is close to the maximum or minimum value so that the grayscale transition cannot be sufficiently emphasized.

In the case above, if the grayscale transition emphasizing section 55 and the sub-frame data generating section 22 emphasize grayscale transition with the assumption that the luminance at the start of the current sub-frame has reached the luminance indicated by the data D5*a* and D5*b* in the first sub-frame, the grayscale transition may be excessive or insufficient.

In particular, when (rising) grayscale transition to increase luminance and (decaying) grayscale transition to decrease luminance are alternately repeated, the grayscale transition is excessive and hence the luminance of the pixel PIX is inappropriately high. As a result, the user is likely to take notice of the inappropriate grayscale transition emphasis and hence the image quality may be deteriorated.

As described above, the present embodiment is arranged in such a manner that voltages V1 and V2 corresponding to sets of data D5*a* and D5*b* are applied to the pixel PIX so that the pixel PIX simulates impulse-type light emission. The luminance that the pixel PIX should have increased or decreased in each sub-frame. Therefore the image quality may be deteriorated by inappropriate grayscale transition emphasis with the assumption above.

In this connection, in the present embodiment, prediction is highly precisely carried out with reference to a predicted value E, as compared to the assumption above. It is therefore possible, by simulating impulse-type light emission, to prevent grayscale transition emphasis from being inappropriate, even if transition from rise to decay frequently occurs. As a result, the quality of moving images is improved by simulating impulse-type light emission, without causing deterioration in image quality due to inappropriate grayscale transition emphasis.

Moreover, in the present embodiment, the sub-frame data generating section 22 reads out D4 in accordance with a specific clock and generates sets of data D5*a* and D5*b* for the sub-frames. With this arrangement, the first sub-frame period (the above-mentioned $Dcf \times V\alpha \times H\alpha$) becomes constant (fixed) regardless of the type (frequency) of an input signal (input video data). This makes it possible to avoid the problem that the prediction varies with change in display luminance of the first sub-frame according to the type (frequency) of an input signal (or uneconomical conditions in which LUTs or the like corresponding to the various kinds of input signals are prepared).

The response speed of a liquid crystal cell which is in the vertical alignment mode and the normally black mode is slow in decaying grayscale transition as compared to rising grayscale transition. Therefore, even if modulation and driving are performed in such a way as to emphasize grayscale transition, a difference between actual grayscale transition and desired grayscale transition tends to occur in grayscale transition from the last but one sub-frame to the last sub-frame. Therefore, an exceptional effect is obtained when the aforesaid liquid crystal cell is used as the pixel array.

Next, the following will describe an arrangement in which a modulation processing section is provided in the stage directly subsequent to the sub-frame processing section.

Figure 3:
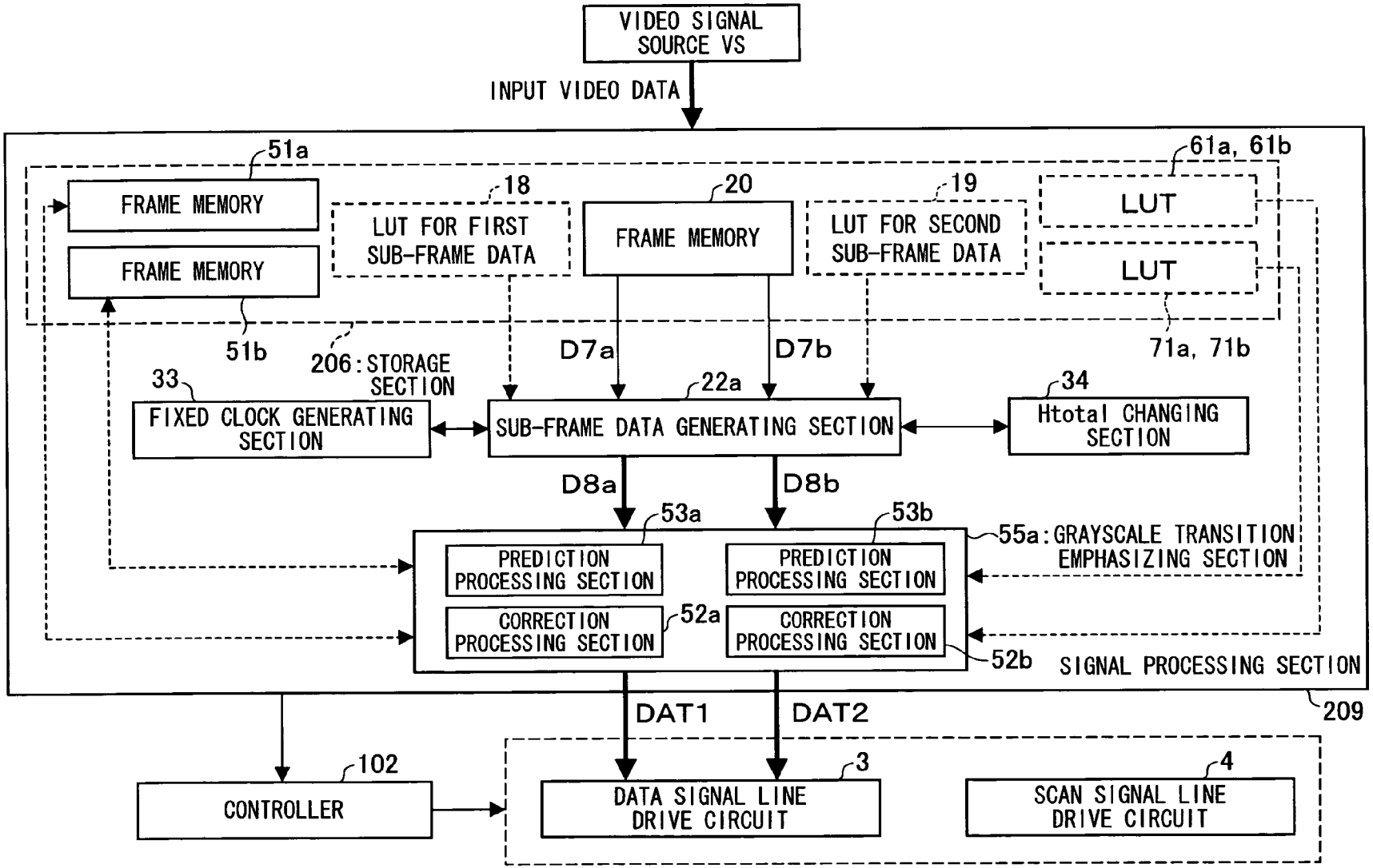
FIG. 3 is a block diagram illustrating a modified example of a signal processing section according to Second Embodiment.

As illustrated in FIG. 3, a signal processing circuit 209 is provided with a grayscale transition emphasizing section 55*a* and a sub-frame data generating section 22*a*, whose operations are substantially identical with those of the grayscale transition emphasizing section 55 and the sub-frame data generating section 22 (see FIGS. 1 and 2). It should be noted that the sub-frame data generating section 22*a* of the present embodiment is provided in the stage directly prior to the grayscale transition emphasizing section 55*a*, performs frame division with respect to data D6 before correction, and outputs sets of video data D8*a* and D8*b* in the respective sub-frames, which sets of video data correspond to the data D6. LUTs 61*a* and 71*a* stored in the storage section 206 are the ones for data D8*a*, whereas and LUTs 61*b* and 71*b* stored in the storage section 206 are the ones for data D8*b*.

Because of the change in the circuit configuration, the grayscale transition emphasizing section 55*a* corrects sets of data S8*a* and D8*b* in the respective sub-frames to emphasize grayscale transition, and outputs the corrected data as sets of data DAT1 and DAT2.

Correction and prediction by the grayscale transition emphasizing section 55*a* are performed for each sub-frame. The grayscale transition emphasizing section 55*a* corrects the sets of data D8*a* and D8*b* of the current sub-frame based on (1) a predicted value E of the first sub-frame, which is read out from a frame memory 51*a* and (2) the sets of data D8*a* and D8*b* in the current sub-frame, which are supplied to the pixel PIX. The grayscale transition emphasizing section 55*a* predicts a value indicating a grayscale which corresponds to luminance to which the pixel PIX is assumed to reach at the start of the next sub-frame, based on the predicted value E and the sets of data D8*a* and D8*b*. The grayscale transition emphasizing section 55*a* then stores the predicted value E in the frame memory. The following will describe in detail.

The correction processing section 52*a* and the prediction processing section 53*a* receive data D8*a* supplied from the sub-frame data generating section 22*a*. The correction processing section 52*a* outputs the corrected data as data DAT1. Similarly, the correction processing section 52*b* and the prediction processing section 53*b* receive data D8*b* supplied from the sub-frame data generating section 22*a*. The correction processing section 52*a* outputs the corrected video data as data DAT2. In the meanwhile, the prediction processing section 53*a* outputs a predicted value E1 not to a frame memory 51*a* that the correction processing section 52*a* refers to but to a frame memory 51*b* that the correction processing section 52*b* refers to. The prediction processing section 53*b* outputs a predicted value E2 to the frame memory 51*a*.

The predicted value E1 indicates a grayscale corresponding to luminance to which the pixel PIX is assumed to reach at the start of the next sub-frame, when the pixel PIX is driven by data DAT1 supplied from the correction processing section 52*a*. The prediction processing section 53*a* predicts the predicted value E1, based on the data D8*a* of the current frame and the predicted value E2 of the previous frame, which value is read out from the frame memory 51*a*. Similarly, the predicted value E2 indicates a grayscale corresponding to luminance to which the pixel PIX is assumed to reach at the start of the next sub-frame, when the pixel PIX is driven by data DAT2 supplied from the correction processing section 52*b*. The prediction processing section 53*b* predicts the predicted value E2, based on the data D8*b* of the current frame and the predicted value E1 read out from the frame memory 51*b*.

In the arrangement above, certain frame data of input video data D6 are stored in the frame memory 20. The sub-frame data generating section 22*a* reads out the data D6 twice in each frame as D7*a* and D7*b*. In the first readout, the sub-frame data generating section 22*a* outputs data D8*a* for the sub-frame in reference to the LUT 18. In the second readout, the sub-frame data generating section 22*a* outputs data D8*b* for the sub-frame in reference to the LUT 19. In the meanwhile, the frame memory 51*a* stores a predicted value E2 which has been updated with reference to data DAT2 of the sub-frame in the previous frame. The correction processing section 52*a* corrects data D8*a* supplied from the sub-frame data generating section 22*a*, with reference to the predicted value E2, and the outputs the corrected data as data DAT1. In a Similar manner, the prediction processing section 53*a* generates a predicted value E1 based on the video data D8*b* and the predicted value E2, and stores the generated predicted value E1 in the frame memory 51*b*.

Similarly, the correction processing section 52*b* corrects data D8*b* with reference to the predicted value E1, and outputs the corrected data as data DAT2. The prediction processing section 53*b* generates a predicted value E2 based on the data D8*b* and the predicted value E1, and stores the generated value E2 in the frame memory 51*a*.

In the present embodiment, the sub-frame data generating section 22*a* reads out D6 in accordance with a specific clock and generates sets of data D8*a* and D8*b* for the sub-frames. With this arrangement, the first sub-frame period ($Dcf \times V\alpha \times H\alpha$) becomes fixed regardless of the type (frequency) of an input signal (input video data). This makes it possible to avoid the problem that accuracy of the prediction decreases according to the type (frequency) of an input signal and uneconomical conditions in which LUTs or the like corresponding to the various kinds of input signals are prepared.

In addition, the signal processing circuit 209 of the present embodiment performs correction (emphasis of grayscale transition) and prediction for each sub-frame. Prediction can therefore be performed precisely as compared to the first embodiment in which the aforesaid processes are performed in units of frame. It is therefore possible to emphasize the grayscale transition with higher precision. As a result, deterioration of image quality on account of inappropriate grayscale transition emphasis is restrained, and the quality of moving images is improved.

Third Embodiment

Figure 4:
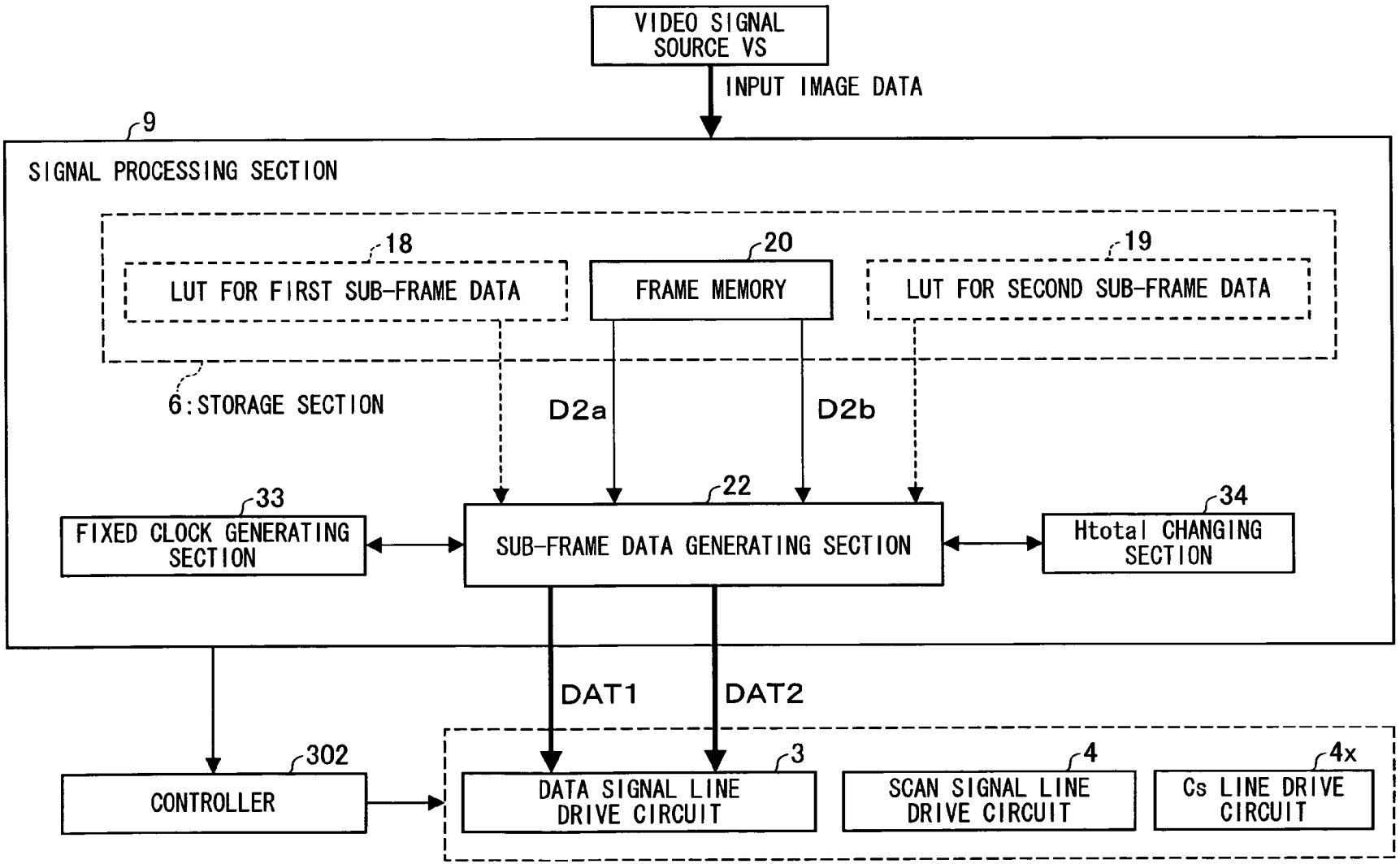
FIG. 4 is a block diagram illustrating a signal processing section according to Third Embodiment.
Figure 17:
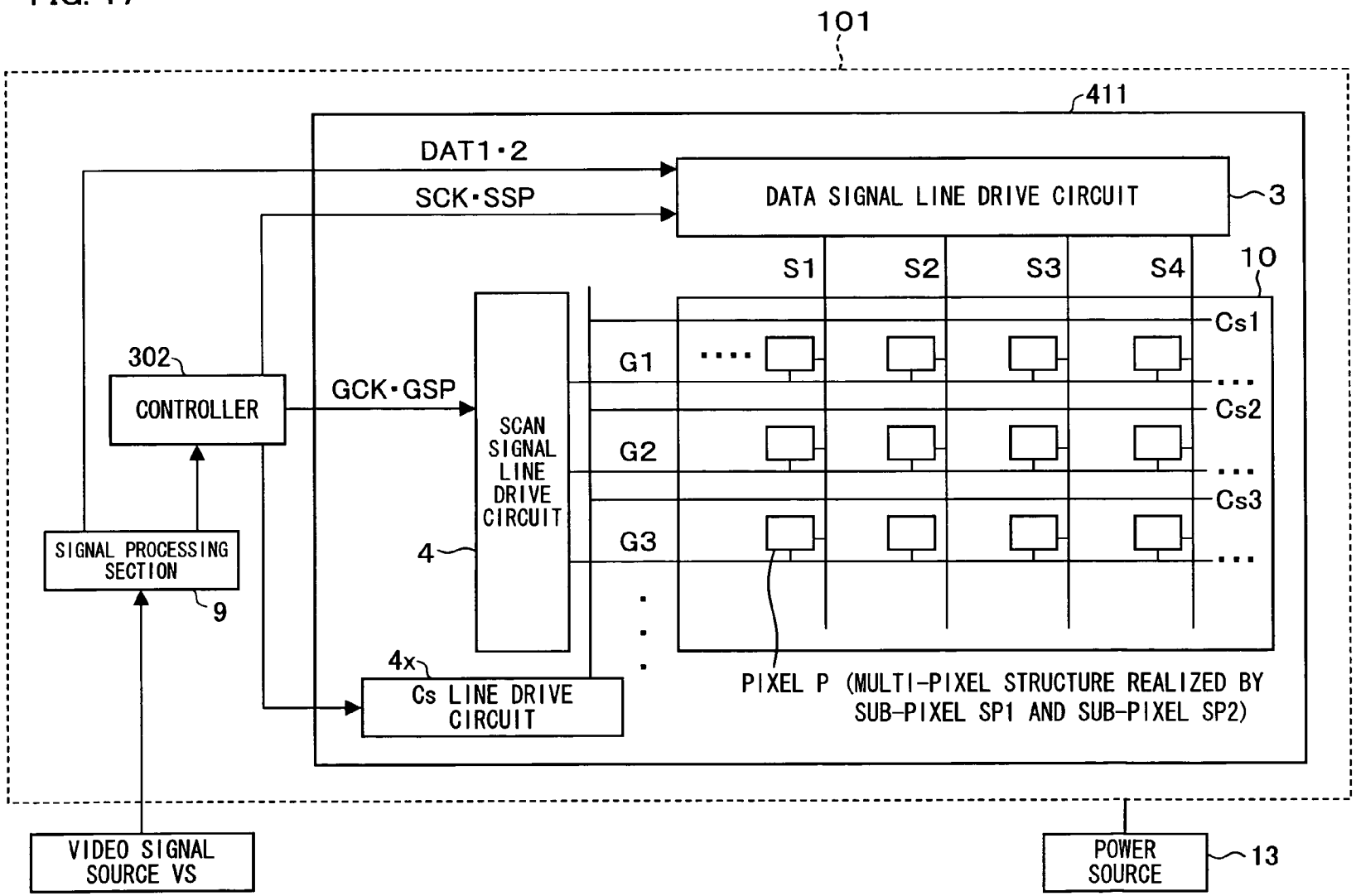
FIG. 17 is a diagram schematically illustrating the structure of a liquid crystal display device according to Third Embodiment.

As illustrated in FIG. 17, the present embodiment has the arrangement (multi-pixel structure) in which a liquid crystal display device performs pixel division driving (area coverage modulation driving). In this arrangement, there is provided a Cs line drive circuit 4*x* (see FIG. 17) controlled by a controller 302, as illustrated in FIG. 4. It should be noted that the members having the same functions as those in the signal processing section 9 in FIG. 1 are given the same reference numerals.

Figure 18:
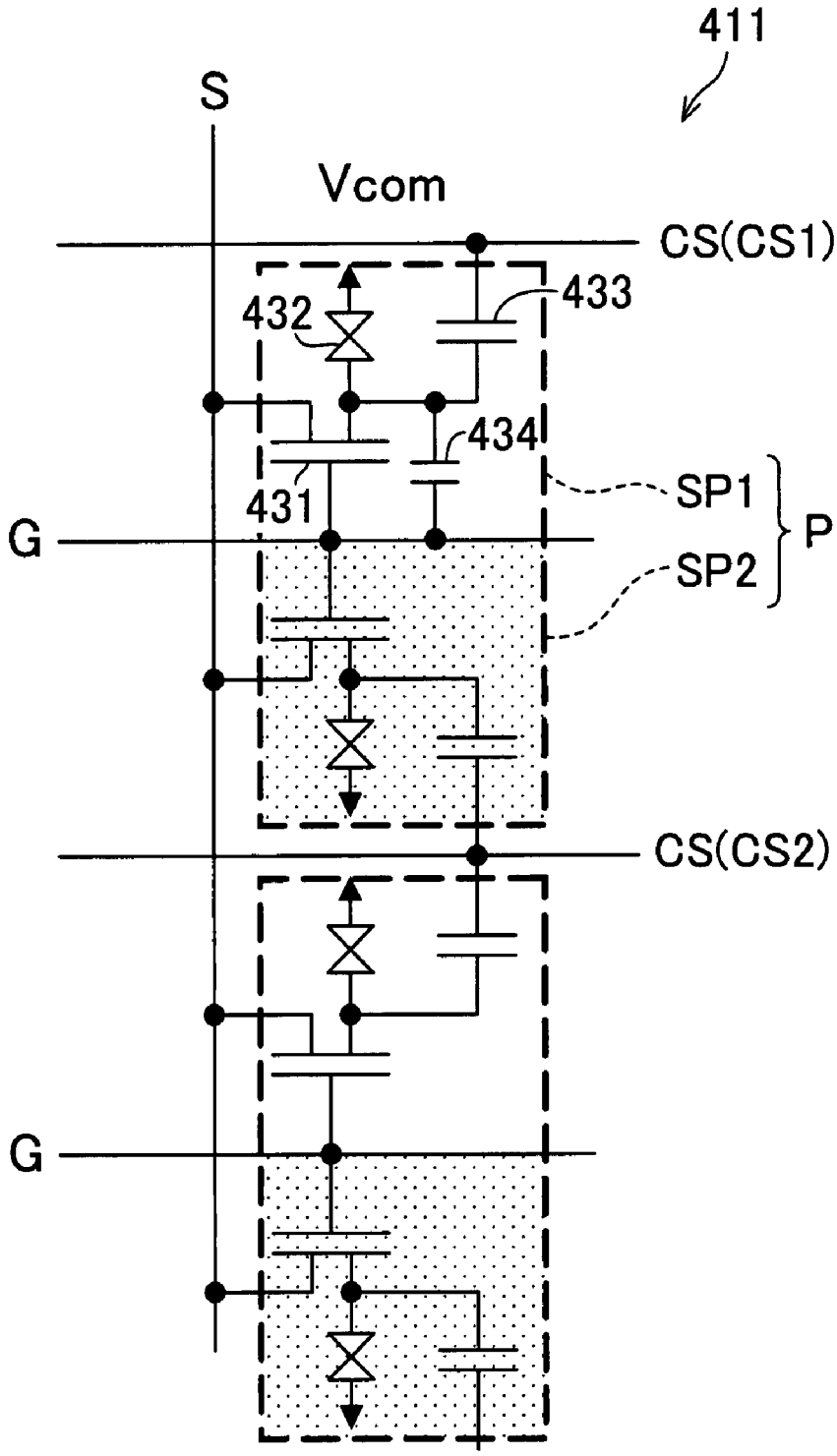
FIG. 18 is a view illustrating the structure of part of the liquid crystal display device illustrated in FIG. 17.

FIGS. 17 and 18 are explanatory views illustrating specific configuration of a liquid crystal panel 411 driven with pixel division. As illustrated in FIG. 18, according to the pixel-division driving, one pixel P connected to a gate line GL and a source line SL of the liquid crystal panel 411 is divided into two sub-pixels SP1 and SP2. Image display is carried out by changing voltages applied to the sub-pixels SP1 and SP2. In the pixel-division driving, luminance of the pixel P is equal to a sum total of luminance (corresponding to the transmittance of liquid crystal) of the two sub-pixels SP1 and SP2.

In a liquid crystal display device 101 which performs the pixel division driving, two different auxiliary capacity lines CS1 and CS2 are provided so as to sandwich one pixel P. Each of the auxiliary capacity lines CS1 and CS2 is connected to one of the sub-pixels SP1 and SP2. In each of the sub-pixels SP1 and SP2, a TFT 431, a liquid crystal capacity 432, and an auxiliary capacity 433 are provided. Further, the auxiliary capacity lines CS1 and CS2 are connected to the Cs line control circuit 4*x* (see FIG. 17).

The TFT 431 is connected to a gate line G, a source line S, and the liquid crystal capacity 432. The auxiliary capacity 433 is connected to the TFT 431, the liquid crystal capacity 432, and one of the auxiliary capacity lines CS1 and CS2. To the respective auxiliary capacity lines CS1 and CS2, auxiliary signals which are alternating voltage signals with predetermined frequencies are applied. The phases of the auxiliary signals applied to the respective capacity lines CS1 and CS2 are opposite to one another (different from one another for 180°).

The liquid crystal capacity 432 is connected to the TFT 431, a shared voltage Vcom, and the auxiliary capacity 433. The liquid crystal capacity 432 is connected to a parasitic capacity 434 generated between the liquid crystal capacity 432 and the gate line G. According to this arrangement, when the gate line G is turned on, the TFTs 431 of the respective sub-pixels SP1 and SP2 in one pixel P are turned on.

FIGS. 8(*a*) and 8(*c*) are graphs related to the case above and show voltages (liquid crystal voltages) applied to the liquid crystal capacities 432 of the sub-pixels SP1 and SP2, in case where a positive display signal (≧Vcom) is applied to the source line S. In this case, as shown in FIGS. 8(*a*) and 8(*c*), the voltage values of the liquid crystal capacities 432 of the respective sub-pixels SP1 and SP2 increase to a value (V0) corresponding to the display signal.

When the gate line G is turned off, the liquid crystal voltages decrease by Vd on account of gate drawing due to the parasitic capacity 434. At this moment, as shown in FIG. 8(*a*), when the auxiliary signal on the auxiliary capacity line CS1 rises (is switched from low to high), the liquid crystal voltage of the sub-pixel SP1 connected to the auxiliary capacity line CS1 increases by Vcs (a value corresponding to the amplitude of the auxiliary signal running on the auxiliary capacity line CS1). In accordance with the frequency of the auxiliary capacity line CS, the liquid crystal voltage oscillates between Vo and V0-Vd, with an amplitude Vcs.

In the case above, as shown in FIG. 8(*c*), the auxiliary signal on the auxiliary capacity line CS2 falls (is switched from high to low). The liquid crystal voltage of the sub-pixel SP2 connected to the auxiliary capacity line CS2 falls by Vcs which is a value corresponding to the amplitude of the auxiliary signal. Thereafter, the liquid crystal voltage oscillates between Vo-Vd and V0-Vd-Vcs.

FIGS. 8(*b*) and 8(*d*) are graphs showing the liquid crystal voltages on the sub-pixels SP1 and SP2, in case where a negative display signal (≦Vcom) is applied to the source line S when the gate line G is turned on. In the case above, as shown in the figures, the liquid crystal voltages on the sub-pixels SP1 and SP2 fall to a value (−V1) corresponding to the display signal. Thereafter, when the gate line G is turned off, the liquid crystal voltages are further decreased by Vd on account of the aforesaid gate drawing.

At this moment, as shown in FIG. 8(*b*), when the auxiliary signal on the auxiliary capacity line CS1 falls, the liquid crystal voltage of the sub-pixel SP1 connected to the auxiliary capacity line CS1 is further decreased by Vcs. The liquid crystal voltage then oscillates between −V0-Vd-Vcs and −V0-Vd. In the meanwhile, as shown in FIG. 8(*d*), the auxiliary signal of the auxiliary capacity line CS2 rises in the case above. The liquid crystal voltage of the sub-pixel SP2 connected to the auxiliary capacity line CS2 is increased by Vcs. Thereafter, the liquid crystal voltage oscillates between V0-Vd and V0-Vd-Vcs.

In this way, auxiliary signal whose phases are different from one another for 180° are applied to the respective auxiliary capacity lines CS1 and CS2, and hence the liquid crystal voltages of the sub-pixels SP1 and SP2 are arranged to be different from one another. That is to say, in case where the display signal applied to the source line S is positive, the absolute value of the liquid crystal voltage is higher than the display signal voltage (FIG. 8(*a*)) in the sub-pixel to which the auxiliary signal which rises immediately after the gate drawing is supplied. On the other hand, in the sub-pixel to which the auxiliary signal which falls in the case above is supplied, the absolute value of the liquid crystal voltage is lower than the display signal voltage (FIG. 8(*c*)).

In case where the display signal applied to the source line S is negative, the absolute value of the voltage applied to the liquid crystal capacity 32 is higher than the display signal voltage (FIG. 8(*b*)) in the sub-pixel to which the auxiliary signal which falls immediately after the gate drawing is supplied. On the other hand, in the sub-pixel to which the auxiliary signal which rises in the case above is supplied, the absolute value of the liquid crystal voltage is lower than the display signal voltage (FIG. 8(*d*)).

Therefore, in the case shown in FIGS. 8(*a*)-8(*d*), the liquid crystal voltage (absolute value) of the sub-pixel SP1 is higher than that of the sub-pixel SP2 (i.e. display luminance of the sub-pixel SP1 is higher than that of the sub-pixel SP2). The difference (Vcs) between the liquid crystal voltages of the respective sub-pixels SP1 and SP2 can be controlled in accordance with the amplitude of each of the auxiliary signals applied to the respective auxiliary capacity lines CS1 and CS2. This makes it possible to optionally differentiate the display luminance (first luminance) of the sub-pixel SP1 from the display luminance (second luminance) of the sub-pixel SP2.

FIG. 8(*e*) illustrates (i) the polarities of respective liquid crystal voltages supplied to the sub-pixel (bright pixel) with high luminance and the sub-pixel (dark pixel) with low luminance and (ii) the states of the auxiliary signals immediately after the gate drawing. In the table the polarities of the liquid crystal voltages are indicated by "+, −". Also, the case where the auxiliary signal rises immediately after the gate drawing is indicated by "↑", whereas the case where the auxiliary signal falls immediately after the gate drawing is indicated by "↓".

Figure 9:
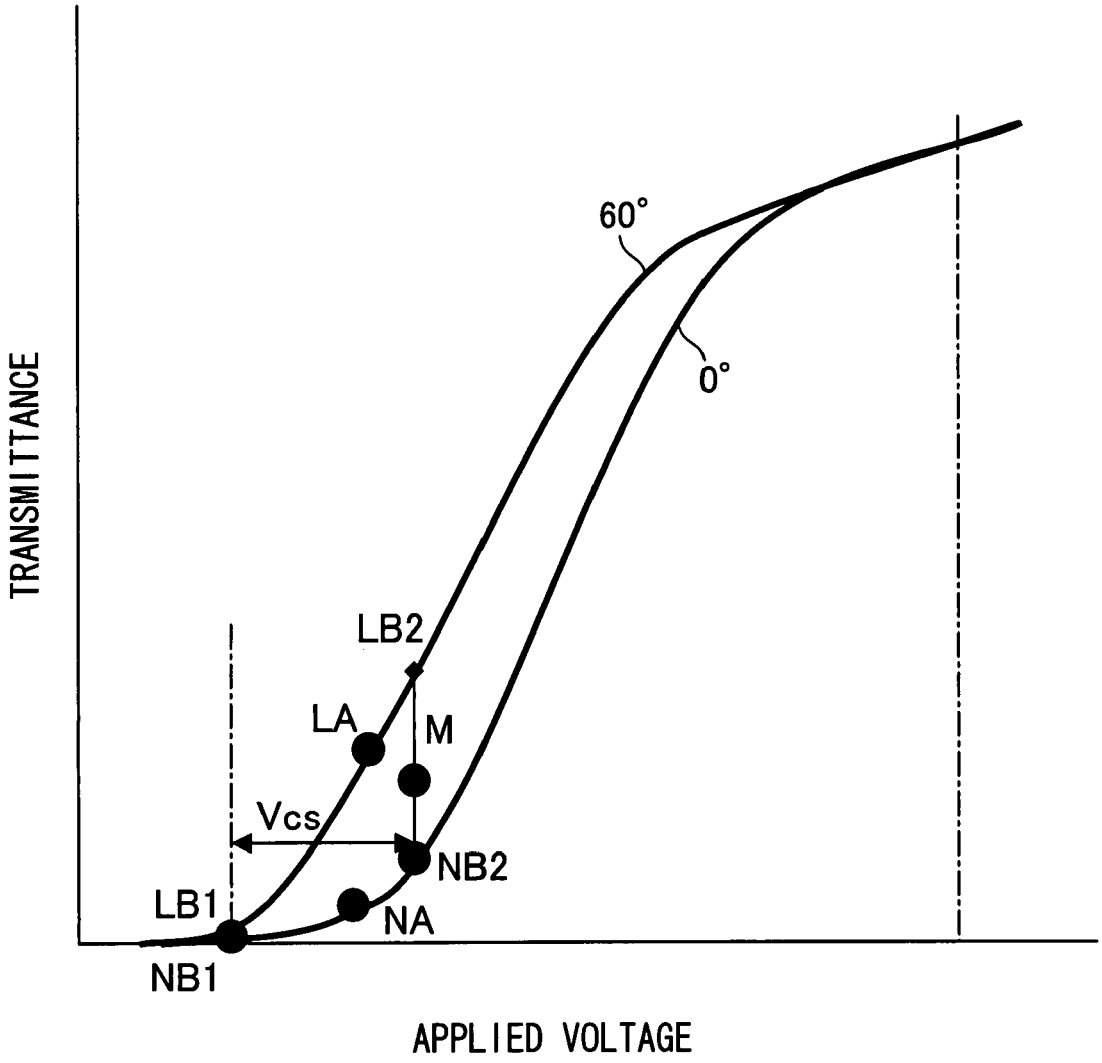
FIG. 9 is a graph showing relations between the transmittance and an applied voltage in a liquid crystal panel at two different viewing angles (0° (head-on) and 60°), when pixel division driving is not carried out.

FIG. 9 is a graph showing the relationship between transmittance and an applied voltage of the liquid crystal panel 421 at two viewing angles (0° (head-on) and 60°), in case where the pixel division driving is not adopted.

As shown in the graph, in case where the transmittance when viewed head-on is NA (i.e. in case where the liquid crystal voltage is controlled so that the transmittance is NA), the transmittance at the viewing angle of 60° is LA. To set the transmission when viewed head-on at NA in the pixel division driving, voltages which are different from one another by Vcs are applied to the respective sub-pixels SP1 and SP2 so that transmittances of the sub-pixels SP1 and SP2 are set at NB1 and NB2 (NA=(NB1+NB2)/2).

In case where the transmittances of the sub-pixels SP1 and SP2 at the angle of 0° are NB1 and NB2, the transmittances at the angle of 60° are LB1 and LB2. LB1 is substantially 0. Therefore, the transmittance of one pixel is M(LB2/2), and hence lower than LA. In this way, the pixel division driving makes it possible to improve the viewing angle characteristic.

Also, adopting the pixel division driving, for example, an image with low luminance (high luminance) can be displayed by increasing the amplitude of the CS signal so as to cause one sub-pixel to carry out dark grayscale display (white display) and to adjust the luminance of the other sub-pixel. This minimizes the difference between display luminance and actual luminance in one of the sub-pixels as in the case of the sub-frame display, and hence the viewing angle characteristic is further improved.

In the arrangement above, one of the sub-pixels may not carry out dark grayscale display (white display). That is to say, the viewing angle characteristic is improved in theory by differentiating the luminances of the respective sub-pixels. Since this reduces the CS amplitude, the panel drive can be easily designed. It is unnecessary to differentiate the luminances of the sub-pixels SP1 and SP2 for all display signals.

For example in case where the respective sub-pixels carry out white display and dark grayscale display, the luminances of the respective sub-pixels are preferably equal. Therefore, the sub-pixels SP1 and SP2 are designed so that, in response to at least one display signal (display signal voltage), first luminance is attained by the sub-pixel SP1 whereas second luminance which is different from the second luminance is attained by the sub-pixel SP2.

In the pixel division driving, the polarity of a display signal applied to the source line S is preferably reversed in each frame. In other words, provided that in one frame the sub-pixels SP1 and SP2 are driven as shown in FIGS. 8(*a*) and 8(*c*), in the subsequent frame the sub-pixels SP1 and SP2 are preferably driven as shown in FIGS. 8(*b*) and 8(*c*).

This causes the total voltage on two liquid crystal capacities 32 of the pixel P in two frames to be 0V. It is therefore possible to cancel the DC component of the applied voltage. To perform the pixel division driving, one pixel is divided into two pixels. Alternatively, one pixel may be divided into three or more sub-pixels. The above-described pixel division driving may be combined with the normal hold display or the sub frame display.

Figure 10:
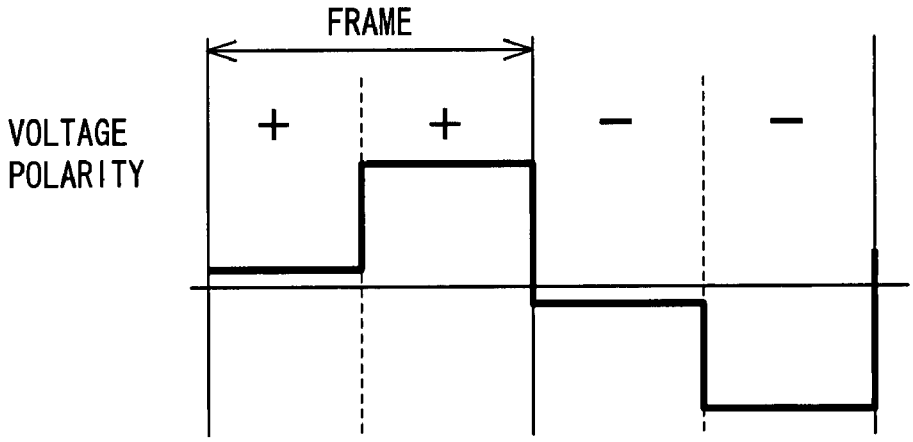
FIG. 10(*a*) is a graph showing a variation of liquid crystal voltage (for one pixel) in case where sub frame display is carried out while the polarity of liquid crystal voltage is reversed in each frame.
Figure 10:
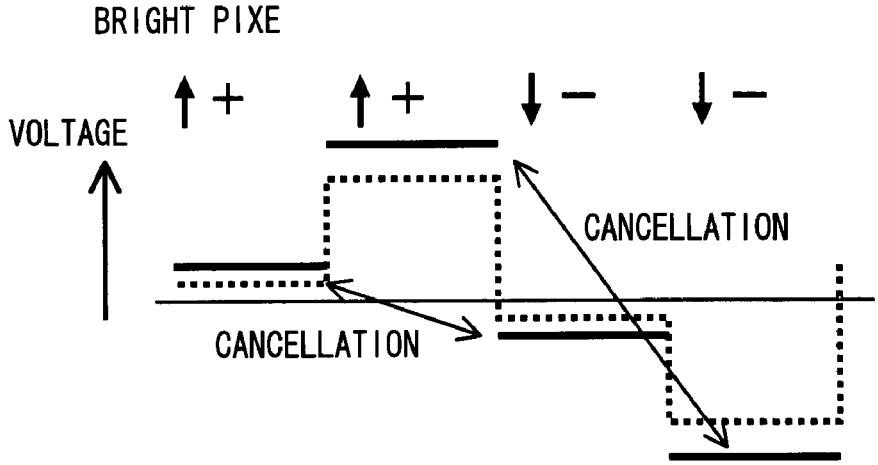
Figure 10:
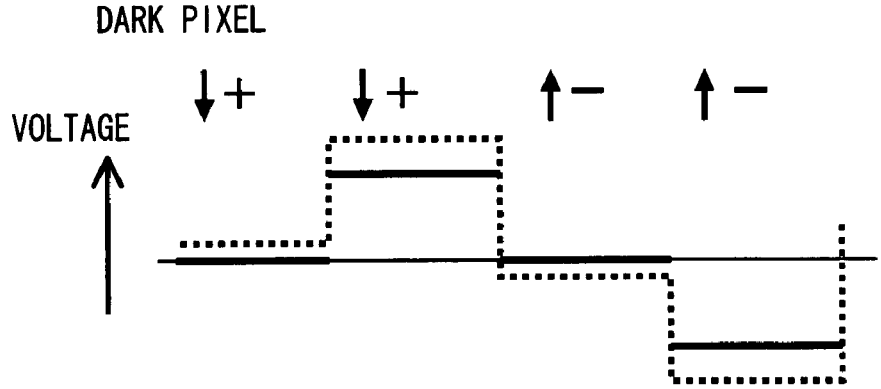

The following will describe a combination of the pixel division driving, the sub frame display, and the polarity reversal driving. FIG. 10(*a*) is a graph showing changes in the liquid crystal voltage (for one pixel), in the case of the sub frame display in which polarity of the liquid crystal voltage is reversed in each frame.

In case where the sub frame display by the polarity reversal driving is combined with the pixel division driving, the liquid crystal voltage of each sub-pixel changes as shown in FIGS. 10(*b*) and 10(*c*). FIG. 10(*b*) is a graph showing the liquid crystal voltage of an sub-pixel (bright pixel) whose luminance is high in the pixel division driving. FIG. 10(*c*) is a graph showing the liquid crystal voltage of a sub-pixel (dark pixel) whose luminance is low in the pixel division driving. In the graphs, an undulating line indicates a liquid crystal voltage in case where the pixel-division drive is not performed, whereas a full line indicates a liquid crystal voltage in case where the pixel-division drive is performed.

Figure 11:
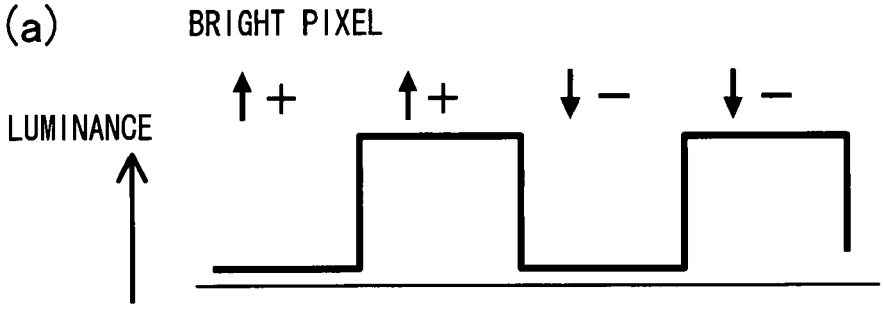
FIG. 11(*a*) is a graph showing the luminance of the bright pixel and dark pixel of FIG. 10(*b*).
Figure 11:
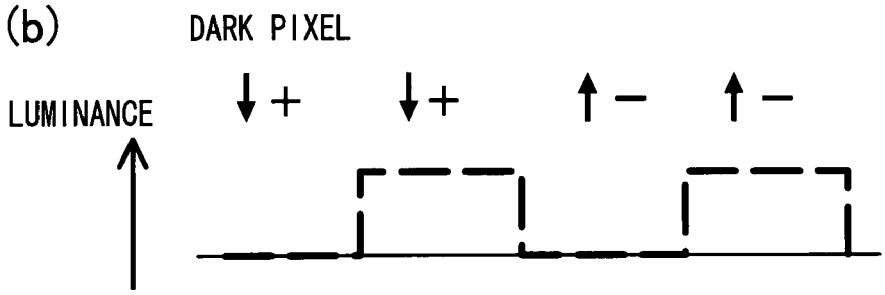

FIGS. 11(*a*) and 11(*b*) are graphs showing luminances of the bright pixel and the dark pixel and correspond to the respective FIGS. 10(*b*) and 10(*c*). In the figures, the signs "↑" and "↓" indicate the states of an auxiliary signal immediately after the gate drawing (i.e. indicate whether the signal rises or falls immediately after the gate drawing).

As shown in these figures, in the present case, the polarity of the liquid crystal voltage of each sub-pixel is reversed in each frame. In doing so, liquid crystal voltages which are different between sub-frames are appropriately cancelled (i.e. total liquid crystal voltage in two frames is set at 0V). The state of the auxiliary signal (i.e. the phase ("↑" and "↓") immediately after the gate drawing) is reversed in the same phase as the reversal of the polarity.

With the driving in this way, as shown in FIGS. 10(*b*), 10(*c*), 11(*a*), and 11(*b*), the liquid crystal voltage (absolute value) and the luminance in the sub frames are high in the bright pixel but low in the dark pixel. The increase in the liquid crystal voltage on the bright pixel in the first sub-frame is equal to the decrease in the dark pixel. Similarly, the increase in the liquid crystal voltage on the bright pixel in the second sub-frame is equal to the decrease in the dark pixel.

Therefore, it is possible to prevent the polarity of the liquid crystal voltage applied to one pixel from being one-sided, and hence the total liquid crystal voltage in two frames is set at 0V. (It is noted that the increase (decrease) in the liquid crystal voltage on account of the pixel division driving is different between the first and second sub-frames. This is because the capacity changes in accordance with the transmittance of liquid crystal.)

In the case above, the polarity of the liquid crystal voltage of each sub-pixel is reversed in each frame. However, this is not only possibility. Alternatively, the polarity of the liquid crystal voltage may be reversed in each frame cycle. The following arrangement may therefore be adopted: the liquid crystal voltage has different polarities in the respective two sub-frames in one frame, and the polarity in the second sub-frame is identical with the polarity in the first sub-frame of the directly precedent frame.

Figure 12:
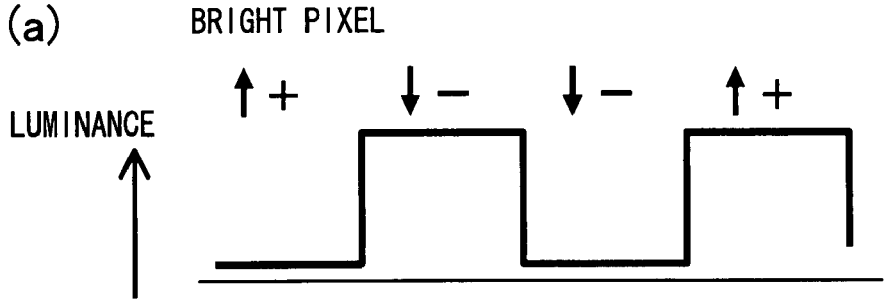
FIG. 12(*a*) is a graph showing the luminance of the bright pixel in case where polarity reversal is carried out in each frame.
Figure 12:
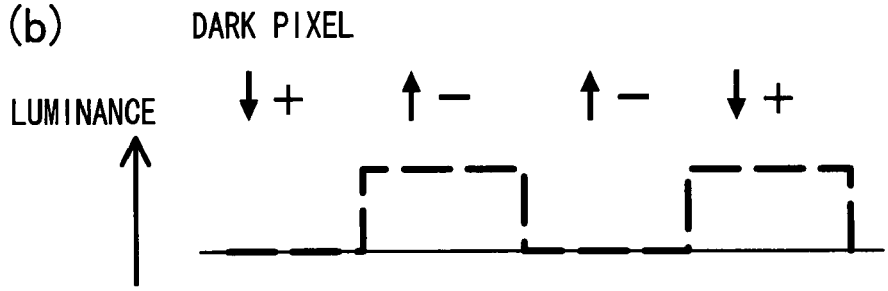

FIGS. 12(*a*) and 12(*b*) are graphs showing the luminances of the bright pixel and dark pixel, in case where the polarity reversal is carried out as above. Also in this case, the state ("↑" or "↓") of the auxiliary signal is reversed in the same phase as the polarity reversal, and hence the total liquid crystal voltage in two frames is set at 0V.

Figure 13:
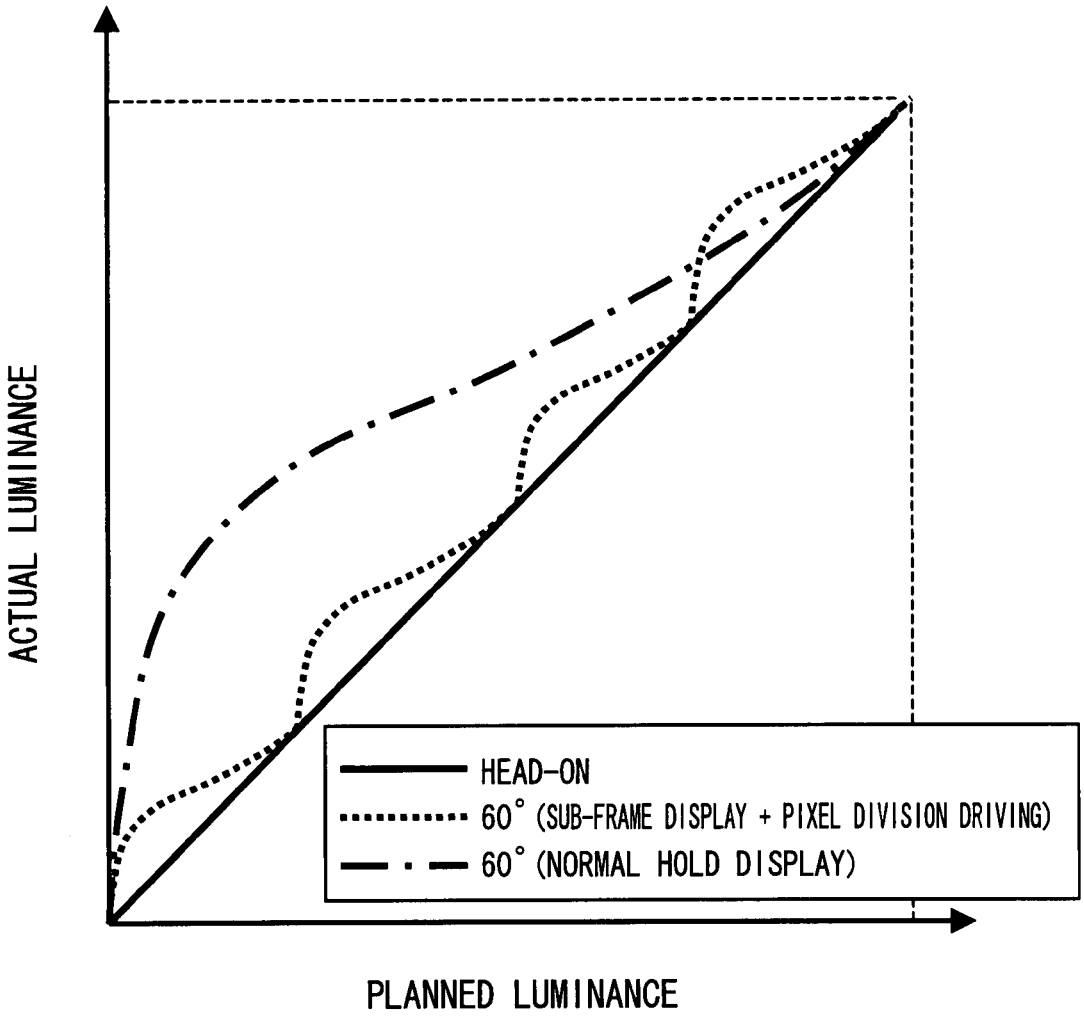
FIG. 13 is a graph showing (i) results (dotted line and full line) of image display by a combination of sub frame display, polarity reversal driving and pixel division driving and (ii) results (dashed line and full line) of normal hold display.

FIG. 13 is a graph showing both (i) the results (dotted line and full line) of image display by the present display device, when the sub frame display, the polarity reversal driving, and the pixel division driving are combined and (ii) the results of normal hold display.

As shown in the graph, in case where the viewing angle is 60°, it is possible to cause actual luminance to be very close to planned luminance by combining the sub frame display with the pixel division driving. The viewing angle characteristic is especially good in this case, on account of the synergistic effect of the sub frame display and the pixel division driving.

In the case above, the state (the phase ("↑" or "↓") immediately after the gate drawing) of the auxiliary signal is reversed in line with the reversal of the polarity. If the state of the auxiliary signal is changed in each frame irrespective of the polarity reversal, the liquid crystal voltage cannot appropriately be cancelled.

That is, the variation of the liquid crystal voltage in accordance with the state of the auxiliary signal depends on the magnitude (absolute value) of the original liquid crystal voltage. (The higher the liquid crystal voltage is, the larger the variation is.) As described above, the increase (decrease) in the liquid crystal voltage in the pixel division driving is different between the first and second sub-frames. (In the example shown in FIGS. 10(*b*) and 10(*c*), the variation in the second sub-frame is larger than the variation in the first sub-frame.)

Figure 14:
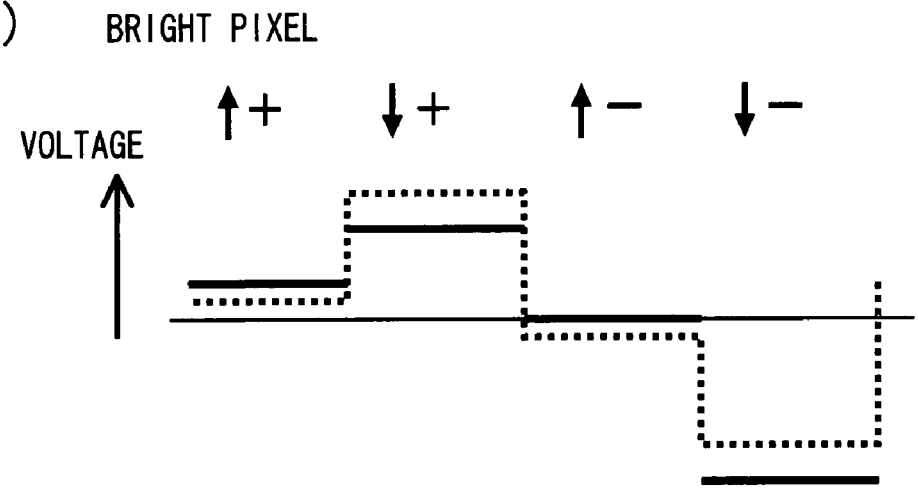
FIG. 14(*a*) is a graph showing the luminance of a bright pixel in case where polarity reversal is carried out in a sub frame cycle.
Figure 14:
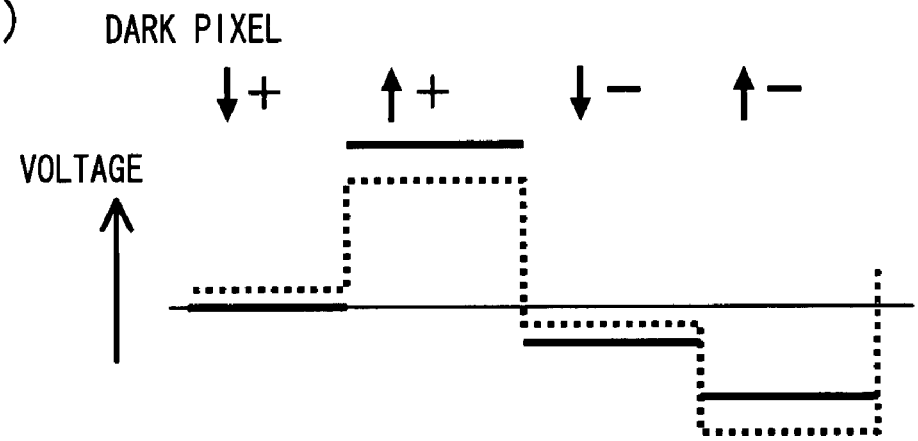

Therefore, in case where the liquid crystal voltage is applied as shown in FIG. 10(*a*), if the state (phase) of the auxiliary signal is reversed in each sub frame, the liquid crystal voltage in the second sub-frame is significantly reduced in the bright pixel as shown in FIG. 14(*a*), whereas the liquid crystal voltage in the first sub-frame is increased a little bit. As shown in FIG. 14(*b*), meanwhile, in the dark pixel, the liquid crystal voltage in the second sub-frame is significantly increased, whereas the liquid crystal voltage in the first sub-frame is decreased a little bit.

Therefore, the total liquid crystal voltage in two frames is not 0V (i.e., negative in the bright pixel whereas positive in the dark pixel), and hence the DC component cannot be cancelled. It is therefore not possible to sufficiently prevent burn-in, flicker, or the like.

The following will describe control of Cs waveform in the present embodiment. A liquid crystal display device is constructed as illustrated in FIGS. 17 and 18, and a signal processing section 309 and a controller 302 are constructed as illustrated in FIG. 4. Settings of the signal processing section 309 are carried out according to a table in FIG. 6. To the respective auxiliary capacity lines CS1 and CS2, auxiliary signals which are alternating voltage signals with predetermined frequencies are applied. The phases of the auxiliary signals applied to the respective capacity lines CS1 and CS2 are different from one another by 180°).

Figure 7:
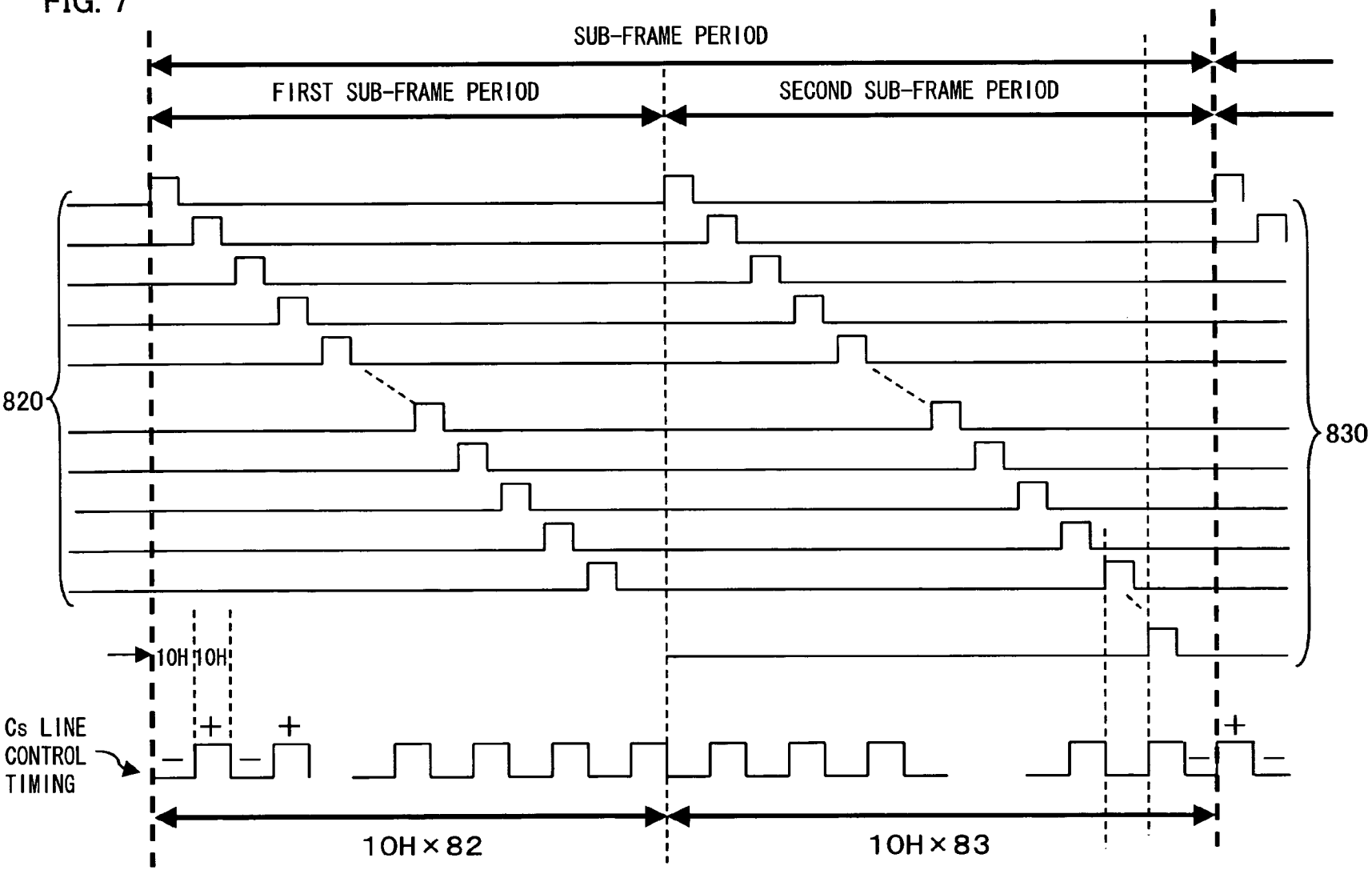
FIG. 7 is a timing chart showing a Cs line control method according to Third Embodiment.

In the present embodiment, the Cs waveform is set so as to be phase shifted by 180° (π) in one frame regardless of a frequency (one frame period) of an input signal. More specifically, as illustrated in FIG. 7, a Cs cycle is an integral multiple of one horizontal line period, and Vtotal (number of lines H1) of the first sub-frame and Vtotal (number of lines H2) of the second sub-frame are set to fixed values (regardless of a frequency of an input signal). In addition, their total line period (H1 line period+H2 line period in one frame) is (2n+1) times a half cycle of the Cs waveform.

With the above arrangement, since Vtotal (number of lines H1) of the first sub-frame and Vtotal (number of lines H2) of the second sub-frame are set to fixed values even when a frame period changes according to various kinds of input signals (e.g. 16.6 ms and 20 ms), the Cs waveform is phase shifted by precisely 180° (π) in one frame and, the polarity of liquid crystal voltage is reversed in each frame.

With the above arrangements illustrated in FIGS. 6 and 7, polarity difference is not more than 1H, and polarity difference through the entire period is not more than 1/3000. Thus, it is possible to realize extremely excellent CS control. Assuming CS variation of 2.5V, the polarity difference results in a voltage difference of not more than 20 mV, which normally causes unrecognizable difference in grayscale. Without the above arrangements, polarity difference is assumed to be 10H at the maximum, which causes voltage difference of 200 mV (which is equivalent to grayscale difference by several grayscale levels in a low grayscale region). In this case, an adverse effect caused by the voltage difference can be clearly perceived. Note that Integral of the polarity difference of only not more than 1H results in clearly perceived timing differences. For this reason, it is preferable that a phase of Cs waveform is normally reset at the beginning or end of DE (display period).

In the embodiments above, the members constituting the signal processing section 9 (109, 209, 309) and part of the functions may be realized by a combination of a program for realizing the aforesaid functions and hardware (computer) executing the program. For example, the signal processing section 9 (109, 209, 309) may be realized as a device driver which is used when a computer connected to the liquid crystal display device 101 drives the liquid crystal display device 101. In case where the signal processing section 9 (109, 209, 309) is realized as a conversion circuit which is included in or externally connected to the liquid crystal display device 101, and the operation of a circuit realizing the signal processing section 9 (109, 209, 309) can be rewritten by a program such as firmware, the software may be delivered as a storage medium storing the software or through a communication path, and the hardware may execute the software. With this, the hardware can operate as the signal processing section 9 (109, 209, 309) of the embodiments above.

In the cases above, the signal processing section 9(109, 209, 309) of the embodiments above can be realized by only causing hardware capable of performing the aforesaid functions to execute the program.

More specifically, CPU or computing means constituted by hardware which can perform the aforesaid functions execute a program code stored in a storage device such as ROM and RAM, so as to control peripheral circuits such as an input/output circuit (not illustrated). In this manner, the signal processing section 9 (109, 209, 309) of the embodiments above can be realized.

In this case, the signal processing section can be realized by combining hardware performing a part of the process and the computing means which controls the hardware and executes a program code for remaining process. Among the aforesaid members, those members described as hardware may be realized by combining hardware performing a part of the process with the computing means which controls the hardware and execute a program code for remaining process. The computing means may be a single member, or plural computing means connected to each other by an internal bus or various communication paths may execute the program code in cooperation.

A program code which is directly executable by the computing means or a program as data which can generate the program code by a below-mentioned process such as decompression is stored in a storage medium and delivered or delivered through communication means for transmitting the program code or the program by a wired or wireless communication path, and the program or the program code is executed by the computing means.

To perform transmission via a communication path, transmission mediums constituting the transmission path transmit a series of signals indicating a program, so that the program is transmitted via the communication path. To transmit a series of signals, a sending device may superimpose the series of signals indicating the program to a carrier wave by modulating the carrier wave by the series of signals. In this case, a receiving device demodulates the carrier wave so that the series of signals is restored. In the meanwhile, to transmit the series of signals, the sending device may divide the series of signals, which are series of digital data, into packets. In this case, the receiving device connects the supplied packets so as to restore the series of signals. Also, to send a series of signals, the sending device may multiplex the series of signals with another series of signals by time-sharing, frequency-division, code-division, or the like. In this case, the receiving device extracts each series of signals from the multiplexed series of signals and restore each series of signals. In any case, effects similar to the above can be obtained when a program can be sent through a communication path.

A storage medium for delivering the program is preferable detachable, but a storage medium after the delivery of the program is not required to be detachable. As long as the program is stored, the storage medium may be or may not be rewritable, may be or may not be volatile, can adopt any recording method, any can have any shape. Examples of the storage medium are a tape, such as a magnetic tape and a cassette tape; a magnetic disk, such as a flexible disk and a hard disk; a disc including an optical disc, such as a CD-ROM/MO/MD/DVD; a card, such as an IC card; and a semiconductor memory, such as a mask ROM, an EPROM (Erasable Programmable Read Only Memory), an EEPROM (Electrically Erasable Programmable Read Only Memory), or a flash ROM. Also, the storage medium may be a memory formed in computing means such as a CPU.

The program code may instruct the computing means to execute all procedures of each process. Alternatively, if a basic program (e.g. operation system and library) which can execute at least a part of the processes by performing calling by a predetermined procedure has already existed, at least a part of the procedures may be replaced with a code or a pointer which instructs the computing means to call the basic program.

The format of a program stored in the storage medium may be a storage format which allows the computing means to access and execute the program, as in the case of real memory, may be a storage format before being stored in real memory and after being installed in a local storage medium (e.g. real memory or a hard disc) to which the computing means can always access, or may be a storage format before being installed from a network or a portable storage medium to the local storage medium. The program is not limited to a compiled object code. Therefore the program may be stored as a source code or an intermediate code generated in the midst of interpretation or compilation. In any case, effects similar to the above can be obtained regardless of the format for storing a program in a storage medium, on condition that the format can be converted to a format that the computing means is executable, by means of decompression of compressed information, demodulation of modulated information, interpretation, completion, linking, placement in real memory, or a combination of these processes.

Industrial Applicability

A drive unit of a display device of the present invention can perform display with high quality regardless of the type of input video data, and makes it easy to expand grayscale transition emphasis (OS) driving and pixel division driving. On this account, the present invention can be applicable to various display devices such as television receiver and a monitor.

The invention claimed is:

1. A liquid crystal display device in which one frame of image data of a first standard type or a second standard type is divided into sub-frames including a first sub-frame and a second sub-frame, the liquid crystal display device comprising:

a sub-frame data generating section configured to generate sub-frame data corresponding to each of the sub-frames; and a sub-frame period fixing section configured to set a sub-frame period of one of the sub-frames to a fixed time, the sub-frame period being the same regardless of one frame periods stipulated in the first and second standards, the first standard being phase alternating line (PAL), and the second standard being National television System Committee (NTSC).

2. The liquid crystal display device according to claim 1, wherein the fixed time is not higher than a minimum time which causes switching between sub-frames including the sub-frame that has the set sub-frame period to be recognizable.

3. The liquid crystal display device according to claim 1, wherein the fixed time is 8 ms.

4. The liquid crystal display device according to claim 1, wherein the sub-frame period fixing section includes:

a fixed clock generating section configured to generate a fixed clock, and the sub-frame data generating section is configured to use the fixed clock as a dot clock regardless of the one frame period stipulated in a standard for the image data.

5. The liquid crystal display device according to claim 1, wherein the sub-frame period fixing section is configured to set a number of lines scanned in the sub-frame that has the set sub-frame period to a fixed value regardless of the one frame period stipulated in a standard for the image data.

6. The liquid crystal display device according to claim 1, wherein the sub-frame period fixing section is configured to set a number of dots of one line for the sub-frame that has the set sub-frame period to a fixed time regardless of the one frame period stipulated in a standard for the image data.

7. The liquid crystal display device according to claim 1, wherein the sub-frame period fixing section is configured to change a number of dots of one line in a sub-frame other than the sub-frame that has the set sub-frame period according to the one frame period stipulated in a standard for the image data.

8. The liquid crystal display device according to claim 1, wherein at a stage prior to the sub-frame data generating section, a correction section is provided which is configured to correct present image data in accordance with previous image data and the present image data.

9. The liquid crystal display device according to claim 1, wherein at a stage subsequent to the sub-frame data generating section, a correction section is provided which is configured to correct current sub-frame data in accordance with previous sub-frame data and the current sub-frame data.

10. The liquid crystal display device according to claim 1, wherein the sub-frame data generating section is configured to generate first sub-frame data corresponding to the first sub-frame and second sub-frame data corresponding to the second sub-frame so that for low luminance display, a grayscale of the first sub-frame data is set to a value close to a minimum value, and a grayscale of the second sub-frame data is changed, whereas for high luminance display, a grayscale of the first sub-frame data is changed, and a grayscale of the second sub-frame data is set to a value close to a maximum value.

11. The liquid crystal display device according to claim 10, wherein the sub-frame period fixing section is configured to set a sub-frame period of the first sub-frame to the fixed value.

12. The liquid crystal display device according to claim 1, driving the display device in which each pixel has a first sub-pixel and a second sub-pixel that are connected to a same source line and a same gate line, alternating potentials applied to auxiliary capacity lines, which forms auxiliary capacitors with the respective sub-pixels, control the first sub-pixel and the second sub-pixel so that the first sub-pixel and the second sub-pixel provide displays with different luminances, wherein the sub-frame period fixing section is configured to set a total line to a fixed time regardless of the one frame period stipulated in a standard for the image data, the total line being a sum of (i) a-number of lines scanned in the first sub-frame and (ii) a number of lines scanned in the second sub-frame, and a cycle of an alternating potential applied to the auxiliary capacity line is an integral multiple of one line period, and a total line period of the first and second sub-frames is (2n+1) times a half cycle of the alternating potential.

13. The liquid crystal display device according to claim 1, further comprising:

a receiving means configured to receive television broadcast, wherein the liquid crystal display device is configured to function as a liquid crystal television receiver.

14. The liquid crystal display device of claim 1, further comprising:

a frame memory for storing data of the image data;

a first look-up table for storing first sub-frame data corresponding to the first sub-frame; and a second look-up table for storing second sub-frame data corresponding to the second sub-frame.

15. The liquid crystal display device of claim 14, wherein the sub-frame data generating section is configured to read out twice the data of the image data from the frame memory in order to create first video data during a first readout and second video data during a second readout, the sub-frame data generating section is configured to generate the first sub-frame data from the first video data and the first look-up table and generate the second sub-frame data from the second video data and the second look-up table.

16. The liquid crystal display device of claim 15, wherein the first sub-frame data is set to one of a maximum or minimum luminance display and the second sub-frame data is changed to a value different from the data of the image data.

* * * * *